US009938711B2

(12) United States Patent
Grisolia et al.

(10) Patent No.: US 9,938,711 B2
(45) Date of Patent: Apr. 10, 2018

(54) WALL STRUCTURE PENETRATION ATTACHMENT

(71) Applicant: Bayer MaterialScience LLC, Pittsburgh, PA (US)

(72) Inventors: Anthony Grisolia, West Leechburg, PA (US); Bruce Dickson, West Mifflin, PA (US)

(73) Assignee: Covestro LLC, Pittsburgh, PA (US)

( * ) Notice: Subject to any disclaimer, the term of this patent is extended or adjusted under 35 U.S.C. 154(b) by 0 days.

(21) Appl. No.: 14/816,589

(22) Filed: Aug. 3, 2015

(65) Prior Publication Data

US 2017/0037615 A1 Feb. 9, 2017

(51) Int. Cl.

| | |
|---|---|
| ***E04C 1/00*** | (2006.01) |
| ***E04B 1/76*** | (2006.01) |
| ***E04B 1/18*** | (2006.01) |
| ***E04B 2/56*** | (2006.01) |
| ***E04C 2/38*** | (2006.01) |

(52) U.S. Cl.

CPC ..... *E04B 1/7604* (2013.01); *E04B 1/18* (2013.01); *E04B 1/7654* (2013.01); *E04B 2/562* (2013.01); *E04C 2/386* (2013.01)

(58) Field of Classification Search

CPC ..... E04B 1/7604; E04B 2/562; E04B 1/18; E04B 1/7654

USPC ..... 52/309.4, 309.2, 309.16, 317.7, 220.8

See application file for complete search history.

(56) References Cited

U.S. PATENT DOCUMENTS

| | | | | |
|---|---|---|---|---|
| 4,443,988 | A * | 4/1984 | Coutu, Sr. | E04B 1/80 52/309.2 |
| 4,471,591 | A * | 9/1984 | Jamison | E04B 1/10 264/46.4 |
| 4,671,038 | A * | 6/1987 | Porter | E04D 3/352 52/465 |
| 4,765,105 | A * | 8/1988 | Tissington | E04C 2/382 264/46.5 |
| 4,856,244 | A * | 8/1989 | Clapp | E04C 2/386 52/220.1 |
| 5,353,560 | A | 10/1994 | Heydon | |
| 5,724,773 | A * | 3/1998 | Hall | E03D 11/143 52/220.1 |
| 5,950,386 | A | 9/1999 | Shipman et al. | |
| 5,950,389 | A * | 9/1999 | Porter | E04B 1/6145 403/DIG. 15 |
| 5,953,883 | A | 9/1999 | Ojala | |
| 6,085,479 | A | 7/2000 | Carver | |
| 6,205,729 | B1 * | 3/2001 | Porter | B32B 29/00 52/220.1 |
| 6,308,491 | B1 * | 10/2001 | Porter | B32B 5/18 52/309.16 |
| 6,332,304 | B1 | 12/2001 | Fuhrman | |
| 6,408,594 | B1 * | 6/2002 | Porter | E04B 7/22 52/220.1 |
| 6,438,915 | B1 | 8/2002 | Beauboeuf | |

(Continued)

FOREIGN PATENT DOCUMENTS

DE 202014004695 U1 7/2014

*Primary Examiner* — Basil Katcheves
(74) *Attorney, Agent, or Firm* — Donald R. Palladino

(57) ABSTRACT

Wall structures and methods of manufacturing wall structures are described in this specification. The wall structures include a frame, a sheathing board attached to the frame, a penetration attachment panel, and a foam layer.

25 Claims, 18 Drawing Sheets

(56) References Cited

U.S. PATENT DOCUMENTS

| | | | | |
|---|---|---|---|---|
| 6,481,172 | B1 * | 11/2002 | Porter | B32B 5/18 428/317.7 |
| 6,854,218 | B2 | 2/2005 | Weiss | |
| 6,951,079 | B2 | 10/2005 | Weiss | |
| 7,127,856 | B2 | 10/2006 | Hagen, Jr. et al. | |
| 7,168,216 | B2 * | 1/2007 | Hagen, Jr. | B29C 44/186 52/404.3 |
| 8,033,065 | B2 | 10/2011 | Paetkau et al. | |
| 8,065,846 | B2 | 11/2011 | McDonaid et al. | |
| 8,365,497 | B2 | 2/2013 | Rothwell | |
| 8,397,387 | B2 | 3/2013 | Cole et al. | |
| 8,397,465 | B2 | 3/2013 | Hansbro et al. | |
| 8,458,983 | B2 | 6/2013 | Propst | |
| 8,635,778 | B1 | 1/2014 | Hagaman | |
| 8,844,943 | B2 | 9/2014 | Gillman | |
| 8,925,270 | B2 | 1/2015 | Grisolia et al. | |
| 8,959,862 | B1 | 2/2015 | Kreizinger | |
| 2002/0092703 | A1 * | 7/2002 | Gelin | E04B 1/86 181/285 |
| 2004/0016194 | A1 | 1/2004 | Stefanutti et al. | |
| 2010/0011701 | A1 * | 1/2010 | Cole | B26D 3/008 52/749.1 |
| 2011/0173911 | A1 | 7/2011 | Propst | |
| 2011/0214374 | A1 | 9/2011 | Propst | |
| 2012/0011792 | A1 | 1/2012 | DeWildt et al. | |
| 2012/0096765 | A1 | 4/2012 | Weeks | |
| 2012/0240501 | A1 | 9/2012 | Spiegel | |
| 2013/0104480 | A1 | 5/2013 | Smith | |
| 2013/0305643 | A1 | 11/2013 | Singleton et al. | |
| 2013/0312350 | A1 | 11/2013 | Kreizinger | |
| 2014/0115991 | A1 | 5/2014 | Sievers et al. | |
| 2014/0265027 | A1 | 9/2014 | Kreizinger | |
| 2015/0093535 | A1 | 4/2015 | Lambach et al. | |

* cited by examiner

WALL STRUCTURE PENETRATION ATTACHMENT

BACKGROUND

The information described in this background section is not admitted to be prior art.

Insulated wall panels provide thermal insulation for residential homes and buildings and commercial buildings. A wall panel's R-value is its ability to impede heat flow and, therefore, is a measure of the wall panel's thermal insulating capability. The greater the ability to impede heat flow, the higher the R-value, and the more thermally insulating the structure. Thermal insulation standards have become increasingly stricter, requiring higher R-values and continuous insulation on the exterior sides of insulated wall panels.

SUMMARY

This specification relates to wall structures and methods of manufacturing wall structures.

In one example, a wall structure comprises a frame, a sheathing board attached to the frame, a penetration attachment panel, and a foam layer.

In another example, a wall structure comprises a frame comprising a first member, a second member spaced apart from the first member, and two side members extending between the first member and the second member. The first member, the second member, and the two side members each comprise a front surface and a rear surface that collectively form a front frame surface and a rear frame surface. The wall structure also comprises a sheathing board attached to the front frame surface. The sheathing board, the first and second members, and the two side members define a cavity within the frame. A penetration attachment panel is located within the cavity and in contact with a rear-facing surface of the sheathing board. A foam layer is located within the cavity. The foam layer adheres to the penetration attachment panel and the sheathing board, and encapsulates the penetration attachment panel.

In another example, a method of manufacturing a wall structure comprises providing a frame. The frame comprises a first member, a second member spaced apart from the first member, and two side members extending between the first member and the second member. The first member, the second member, and the two side members each comprise a front surface and a rear surface that collectively form a front frame surface and a rear frame surface. A sheathing board is attached to the front frame surface. The sheathing board, the first and second members, and the two side members define a cavity within the frame. A penetration attachment panel is positioned within the cavity and in contact with a rear-facing surface of the sheathing board. A foam layer is deposited into the cavity. The foam layer covers the penetration attachment panel and the sheathing board.

It is understood that the inventions described in this specification are not necessarily limited to the examples summarized in this Summary.

BRIEF DESCRIPTION OF THE DRAWINGS

Various features and characteristics of the inventions described in this specification may be better understood by reference to the accompanying figures, in which.

The reader will appreciate the foregoing features and characteristics, as well as others, upon considering the following detailed description of the inventions according to this specification.

DESCRIPTION

As used in this specification, the term "front" refers to the side, face, or surface of a structure or component oriented towards the outside direction of an exterior wall of a building, and the term "rear" refers to the side, face, or surface of a structure or component oriented towards the inside direction of an exterior wall of a building.

Conventional residential and commercial building construction typically involves the placement of oriented strand boards (OSBs) or other wood-based structural boards on the exterior-facing side of the building frame. The exterior-facing boards provide structural substrates to which exterior fixtures can be attached (e.g., claddings such as vinyl or aluminum siding, plumbing fixtures such as spigots, electrical fixtures such as outlet boxes, lighting fixtures, utility fixtures, vents, and the like). However, with wall structures in which non-structural boards (e.g., foam boards) or other sheathing boards having relatively low fastener pull-out strength replace OSBs or other structural boards on the exterior-facing side of the building frame, there is substantially less structure having sufficiently high fastener pull-out strength to attach or otherwise secure exterior fixtures. Such wall structures are described, for example, in U.S. Patent Application Publication No. 2015/0093535 A1, which is incorporated by reference into this specification. Accordingly, with wall structures comprising a frame and a foam board or other sheathing board having relatively low fastener pull-out strength attached to the exterior-facing side of the frame, a penetration attachment panel can be positioned on and secured to the interior-facing side of the sheathing board to provide a structure having relatively high fastener pull-out strength for attaching and/or securing exterior fixtures that require a penetration into and/or through the wall structure.

Figure 1:
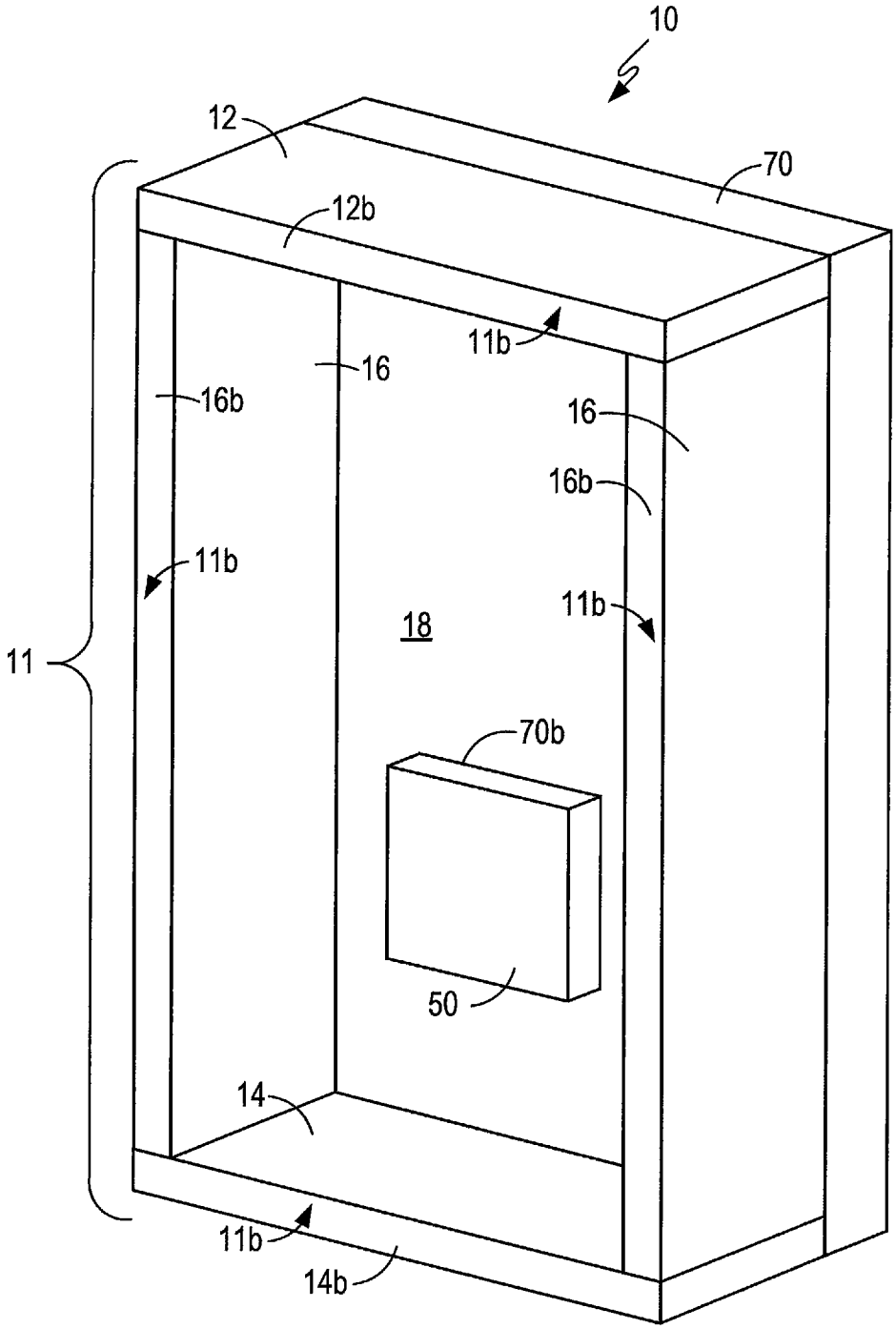
FIG. 1 is a rear perspective schematic diagram of a wall structure comprising a frame, a sheathing board attached to the frame, and a penetration attachment panel.
Figure 2:
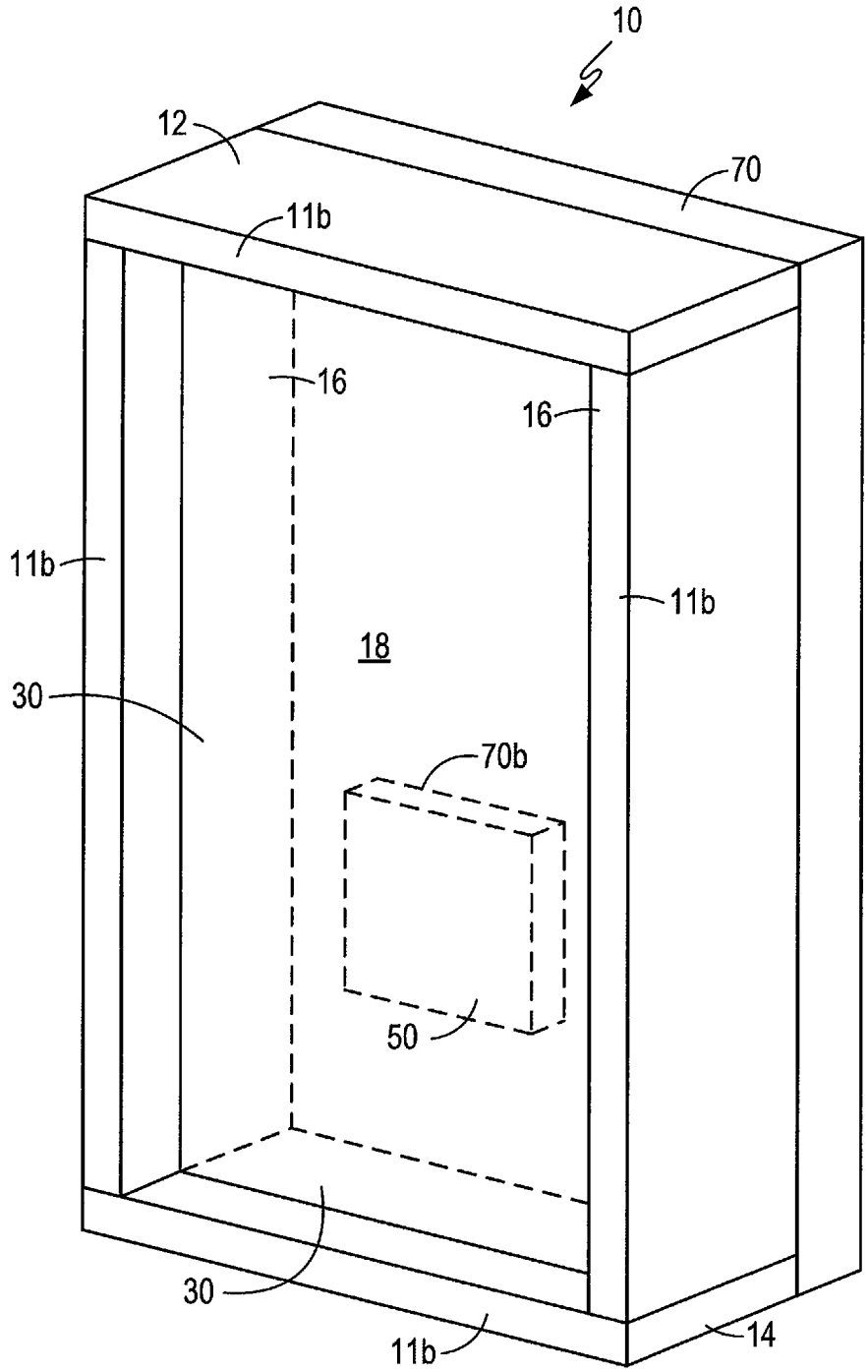
FIG. 2 is a rear perspective schematic diagram of a wall structure comprising a frame, a sheathing board attached to the frame, a penetration attachment panel, and a foam layer.
Figure 3:
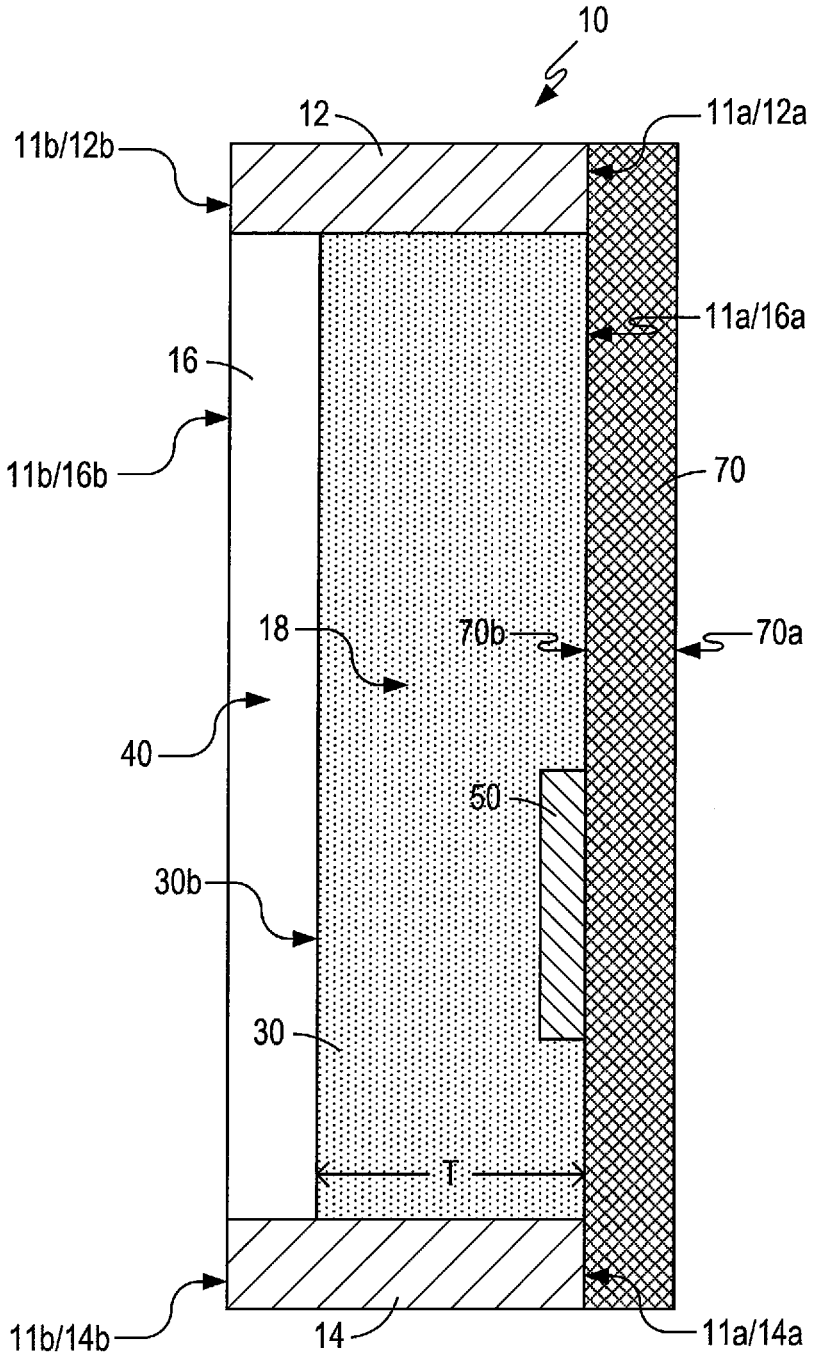
FIG. 3 is a side cross-sectional schematic diagram of the wall structure shown in FIG. 2.

Referring to FIGS. 1-3, a wall structure 10 comprises frame 11. The frame 11 comprises a first member 12, a second member 14 spaced apart from the first member 12, and two side members 16 extending between the first member 12 and the second member 14. The first member 12, the second member 14, and the two side members 16 each comprise a front surface (12*a*, 14*a*, and 16*a*, respectively) and a rear surface (12*b*, 14*b*, and 16*b*, respectively) that collectively form a front frame surface 11*a* and a rear frame surface 11*b*. The constituent members (12, 14, and 16) of the frame 11 can be made out of a suitable material of construction such as wood. For example, the constituent members (12, 14, and 16) of the frame 11 can comprise wooden 2×4 members (i.e., structural members made of wood having nominal thicknesses of about 2-inches, nominal widths of about 4-inches, and suitable lengths) secured together with fasteners such as nails, nail plates, screws, staples, bolts, or rivets, or a combination of any thereof.

A sheathing board 70 may be attached to the front frame surface 11*a*. As used in this specification, the term "sheathing board" refers to boards having relatively low fastener pull-out strength compared to wood boards, plywood boards, and OSBs. Accordingly, in this specification, the term "sheathing board" excludes wood boards, plywood boards, and OSBs. By way of example, sheathing boards include, but are not necessarily limited to, foam boards (e.g., polyiso boards, expanded polystyrene boards, extruded polystyrene boards), gypsum boards, cement boards, adhesive-bonded and laminated cellulosic fiberboards (e.g., Thermo-Ply® boards, available from OX Engineered Products), asphalt-impregnated cellulosic fiberboards (e.g., Celotex® boards, available from Blue Ridge Fiberboard), thermoset resin-wood composite boards (e.g., low-density fiberboard (particle board) and medium-density fiberboard), thermoset resin-mineral wool composite boards (e.g., Roxul® boards, available from Roxul/Rockwool International), and T1-11 siding boards.

Figure 4:
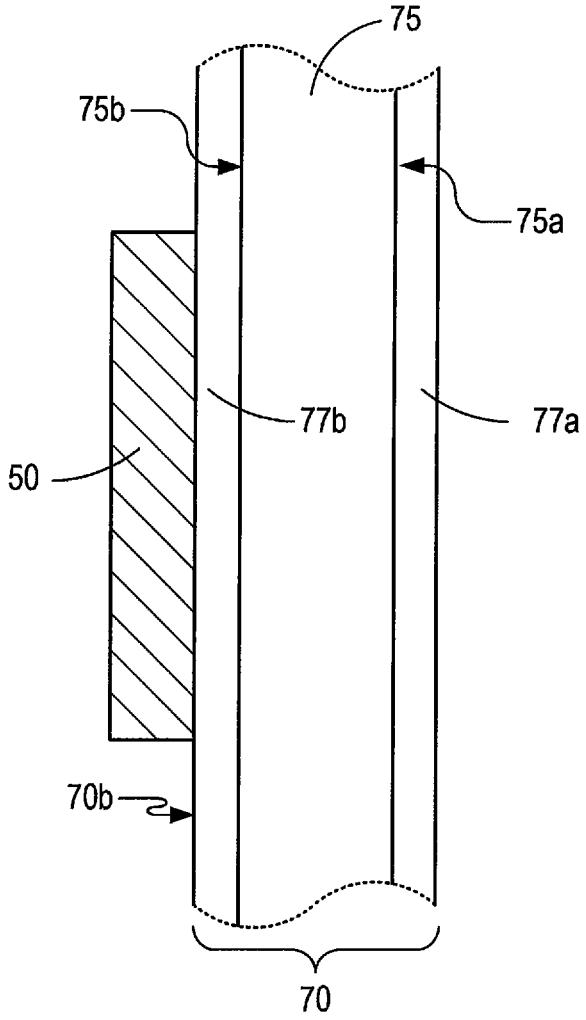
FIG. 4 is a side cross-sectional schematic diagram of a penetration attachment panel positioned on a sheathing board comprising a core layer and facer materials attached to a front face and a rear face of the core layer.

The sheathing board 70 attached to the front frame surface 11*a* can comprise facer materials on the rear face and/or the front face of the sheathing board. For example, referring to FIG. 4, the sheathing board 70 may comprise a polyiso board comprising a polyisocyanurate foam layer 75 and a facer material 77*a*/77*b* attached to a front face 75*a* and/or a rear face 75*b* of the polyisocyanurate foam layer 75. Although FIG. 4 shows facer materials 77*a* and 77*b* respectively attached to both the front face 75*a* and the rear face 75*b* of the polyisocyanurate foam layer 75, it is understood that a polyiso board or other type of sheathing board can comprise a facer material attached to just one face, either the front face or the rear face, of a polyisocyanurate foam layer or other core layer (e.g., expanded polystyrene, extruded polystyrene, gypsum, cement, adhesive-bonded and laminated cellulosic fibers, asphalt-impregnated and formed cellulosic fibers, thermoset resin-wood composites, thermoset resin-mineral wool composite boards, and the like).

Polyiso boards and other types of sheathing boards generally comprise facer materials attached to and substantially covering both sides (the front and rear faces) of a polyisocyanurate foam layer or other core layer. For example, facer materials can comprise glass mats filled with recycled cardboard and colored with carbon black. Facers materials can also comprise foil or foil/glass composites. Facer materials can also comprise fibrous materials such as fiberglass materials or other fiber-reinforced sheet-like materials. Examples of suitable facer materials include, but are not limited to, fiberglass mats, glass fiber-reinforced cellulosic felts, coated and polymer-bonded fiber mats (e.g., fibrous glass mats bonded with an organic polymer binder and coated with an organic polymer coating, clay, or other inorganic coating), foils (e.g., aluminum foil), coated foils, foil/membrane laminates, foil/glass composites, and polyolefin films (such as TYVEK® materials, available from DuPont; or TYPAR® materials, available from Fiberweb, Inc.). If a polyiso board or other type of sheathing board comprises facer materials on both the front and rear faces of the polyisocyanurate foam layer or other core layer, then the facer material on the front face may be the same as or may be different than the facer material on the rear face. The facer material should meet the requirements as described in ASTM D226/D226M-09: Standard Specification for Asphalt-Saturated Organic Felt Used in Roofing and Waterproofing; or ASTM E2556/E2556M-10: Standard Specification for Vapor Permeable Flexible Sheet Water-Resistive Barriers Intended for Mechanical Attachment; or otherwise qualify as a water-resistive barrier in accordance with International Residential Code (IRC) 703.2 (2012), which are each incorporated-by-reference into this specification. For implementations in which the sheathing board comprises a polyiso board, the sheathing board may meet the requirements of ASTM C1289-15: Standard Specification for Faced Rigid Cellular Polyisocyanurate Thermal Insulation Board, which is incorporated-by-reference into this specification.

Referring again to FIGS. 1-3, the sheathing board 70 may be attached to the front frame surface 11*a*. The sheathing board 70 can be attached to any of the front faces (12*a*, 14*a*, and/or 16*a*) of the constituent members (12, 14, and 16) of the frame 11. For example, the sheathing board 70 can be attached to the front faces 12*a* and 14*a* of the first and second members 12 and 14, and to the front faces 16*a* of the two side members 16. The sheathing board 70 can be attached to the front frame surface 11*a* with fasteners and/or an adhesive (not shown). Attachment fasteners can include, but are not limited to, nails, staples, screws, bolts, or rivets, or a combination of any thereof. Attachment adhesives can comprise a construction adhesive that is compatible with the adjoining materials. For example, an adhesive used to attach a sheathing board to a frame can comprise a foam material (which may be the same foam material or a different foam material as the foam material comprising the foam layer, described below).

The sheathing board 70, the first member 12, the second member 14, and the two side members 16 define a cavity 18 within the frame 11. A penetration attachment panel 50 may be located within the cavity 18 and in contact with the rear-facing surface 70*b* of the sheathing board 70. Referring to FIGS. 2 and 3, a foam layer 30 may be located within the cavity 18. The foam layer 30 adheres to the penetration attachment panel 50 and to the sheathing board 70. The foam layer 30 encapsulates the penetration attachment panel 50 within the cavity 18.

In some implementations, the penetration attachment panel 50 is not attached to the sheathing board 70. In such implementations, the penetration attachment panel 50 may be held in contact with the rear-facing surface 70*b* of the sheathing board 70 solely by the encapsulation provided by the foam layer 30. In some implementations, the penetration attachment panel 50 may be attached to the sheathing board 70 with an adhesive.

In implementations in which the penetration attachment panel 50 is not attached to the sheathing board 70 with an adhesive, the penetration attachment panel 50 can directly contact the rear-facing surface 70*b* of the sheathing board 70, and the penetration attachment panel 50 may be encapsulated between the sheathing board 70 and the foam layer 30. In implementations in which the penetration attachment panel 50 is attached to the sheathing board 70 with an adhesive, the penetration attachment panel 50 can indirectly contact the rear-facing surface 70*b* of the sheathing board 70, and the penetration attachment panel 50 can be encapsulated between the adhesive (not shown) and the foam layer 30. The penetration attachment panel 50 can be attached to the sheathing board 70 with a construction adhesive that is compatible with the adjoining materials. Alternatively, an adhesive used to attach a penetration attachment panel to a sheathing board can comprise a foam material (which may be the same foam material or a different foam material as the foam material comprising the foam layer).

Figure 5:
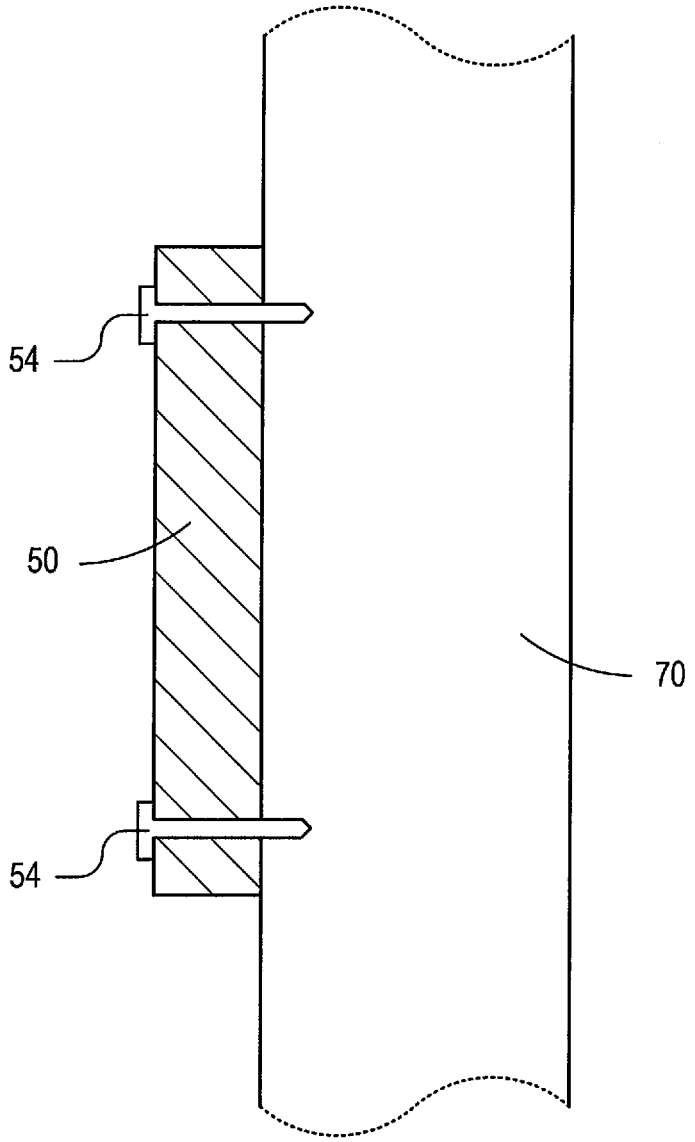
FIG. 5 is a side cross-sectional schematic diagram of a penetration attachment panel positioned on a sheathing board with positioning devices.

In some implementations, the penetration attachment panel 50 can be positioned on the sheathing board 70 with one or more positioning devices. For example, referring to FIG. 5, the penetration attachment panel 50 is shown positioned on the sheathing board 70 with positioning devices 54 located through the thickness of the penetration attachment panel 50 and engaging the sheathing board 70, but not penetrating through the thickness of the sheathing board 70. The positioning devices 54 can aid in maintaining the location of the penetration attachment panel 50 on the sheathing board 70 during the deposition of the foam layer 30. The positioning devices 54 can comprise one or more fasteners such as screws, nails, bolts, pins, or a combination of any thereof. It should be noted, however, that the optional positioning devices 54 do not function to provide significant mechanical attachment between the penetration attachment panel 50 and the sheathing board 70 because of the sheathing board's relatively low fastener pull-out strength. Rather, the optional positioning devices 54 function primarily to maintain placement during manufacture, and the attachment of the panel 50 to the sheathing board 70 is provided by the encapsulating foam layer 30 and any optional adhesive between the panel 50 and the sheathing board 70.

The penetration attachment panel 50 can comprise, for example, a wood panel, a plywood panel, an OSB panel, a wood-thermoplastic composite panel (e.g., a TREX® panel, available from Trex Company, Inc.), or a formed thermoplastic panel (e.g., an extruded poly(vinyl chloride) panel such as an AZEK® panel, available from AZEK Building Products, Inc.). The foam layer 30 (and, optionally, any foam-based adhesive used to attach the sheathing board 70 to the frame 11, and/or attach the penetration attachment panel 50 to the sheathing board 70) can comprise, for example, polyurethane or polyisocyanurate, or mixtures thereof. The foam layer 30 can be substantially free, essentially free, or completely free of halogen-containing flame retardant additives.

As used in this specification, the term "foam" refers to a substance that is formed by trapping pockets of gas in a liquid or solid. A foam layer can comprise a closed-cell foam, wherein the term "closed-cell foam" refers to foam that contains discrete, non-interconnecting cells formed by the trapped pockets of gas. Examples of foam materials include, but are not limited to, foams made with polyurethane, polyisocyanurate (also referred to as polyiso), and mixtures thereof. Foam materials (including the foam layer 30) may be substantially free, may be essentially free, or may be completely free of halogen-containing flame retardant additives. The term "halogen" refers to the halogen elements, which include fluorine, chlorine, bromine, and iodine, and the term "halogen-containing flame retardant additives" refers to a substance that may be used to inhibit or resist the spread of fire, and which contains halogen groups such as a fluoro, chloro, bromo, and/or iodo groups. Further, the term "substantially free," as used in this specification, means the foam material contains less than 1000 parts per million (ppm), "essentially free" means less than 100 ppm, and "completely free" means less than 20 parts per billion (ppb) of halogen-containing flame retardant additives.

Referring to FIG. 3, the foam layer 30 comprises a thickness T extending from the rear-facing surface 70*b* of the sheathing board 70 to a position intermediate the front frame surface 11*a* and the rear frame surface 11*b*. In this manner, a gap 40 may be formed within the frame 11 between a rear-facing surface 30*b* of the foam layer 30 and the rear frame surface 11*b*. Although FIG. 3 shows the foam layer 30 comprising a thickness T extending from the rear-facing surface 70*b* of the sheathing board 70 to a position intermediate the front frame surface 11*a* and the rear frame surface 11*b*, it is understood that the foam layer 30 can alternatively comprise a thickness extending from the rear-facing surface 70*b* of the sheathing board 70 to the rear frame surface 11*b*, in which case no gap is formed within the frame 11 between the rear-facing surface 30*b* of the foam layer 30 and the rear frame surface 11*b*.

Figure 6:
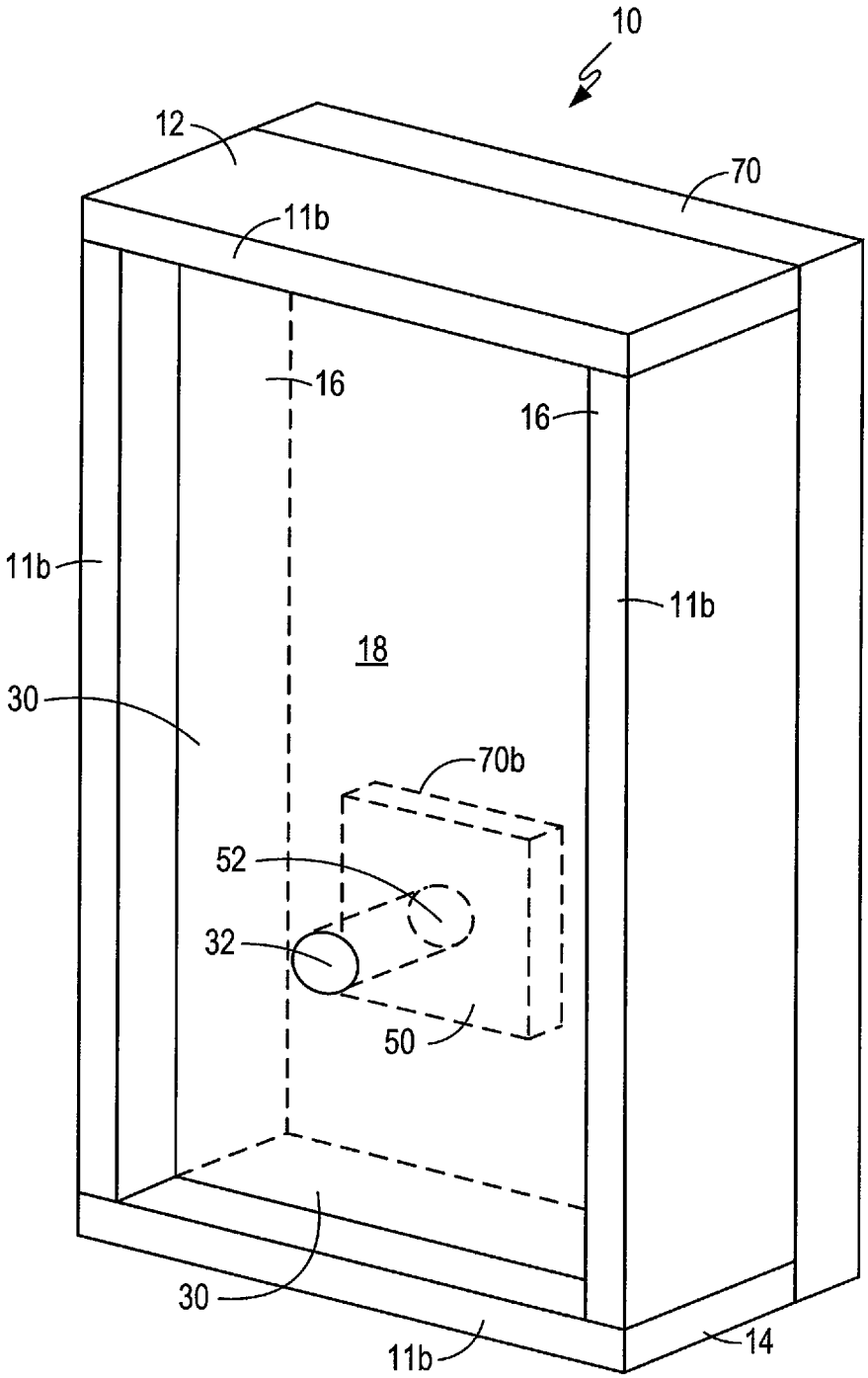
FIG. 6 is a rear perspective schematic diagram of a wall structure comprising a frame, a sheathing board attached to the frame, a penetration attachment panel, a foam layer, and a penetration opening located through the sheathing board and the penetration attachment panel and the foam layer.
Figure 7:
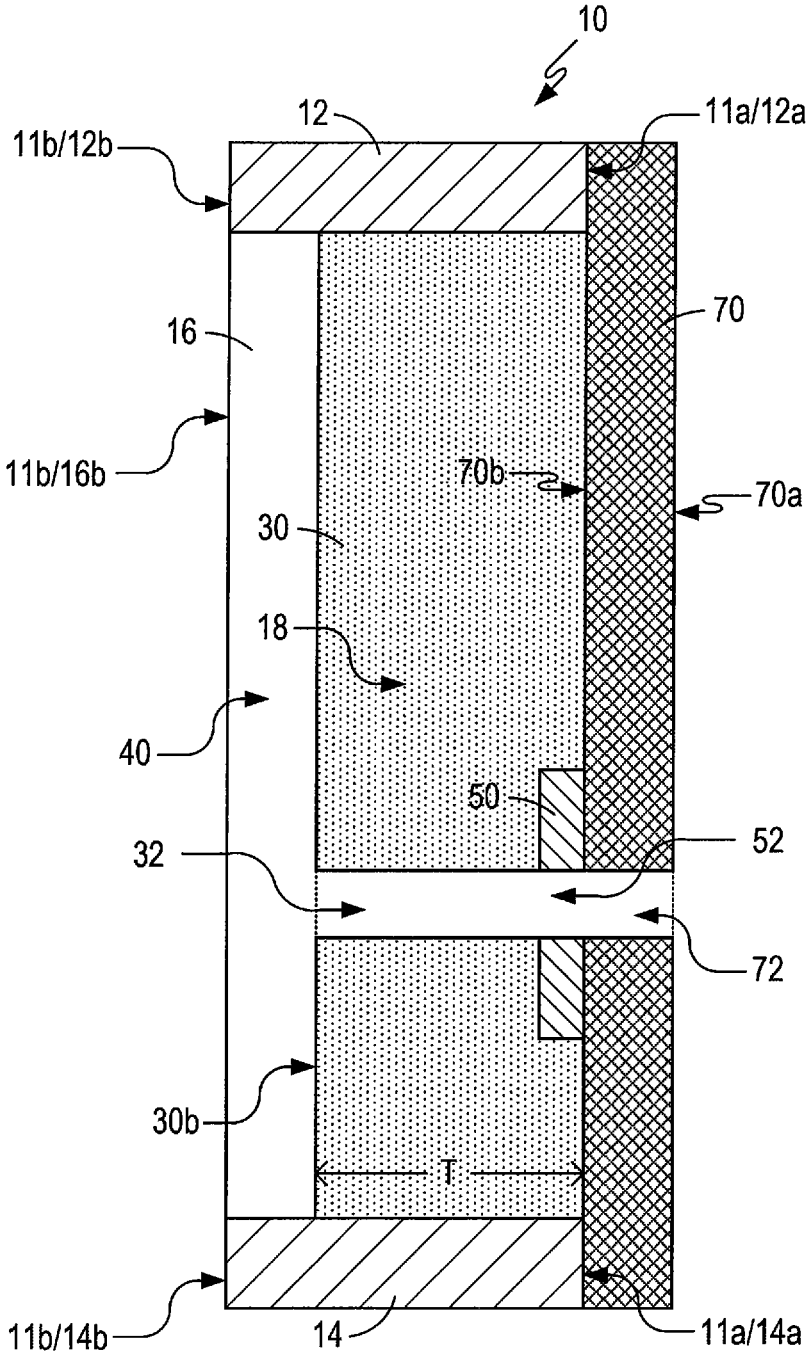
FIG. 7 is a side cross-sectional schematic diagram of the wall structure shown in FIG. 6.

Referring to FIGS. 6 and 7, the wall structure 10 can comprise a penetration opening 72 through the sheathing board 70, a penetration opening 52 through the penetration attachment panel 50, and a penetration opening 32 through the foam layer 30. The penetration openings 72, 52, and 32 collectively provide a penetration opening through the wall structure 10, which connects the front-facing surface 70*a* of the sheathing board 70 and the rear-facing surface 30*b* of the foam layer 30. The penetration opening (72/52/32) through the wall structure 10 provides an open connection between the exterior side of the wall structure and the interior side of the wall structure for the placement of electrical lines, pipelines/plumbing, vents, and the like, which connect to exterior fixtures (e.g., electrical fixtures such as outlet boxes, lighting fixtures, plumbing fixtures such as spigots, other utility fixtures, vent covers, and the like).

Figure 8:
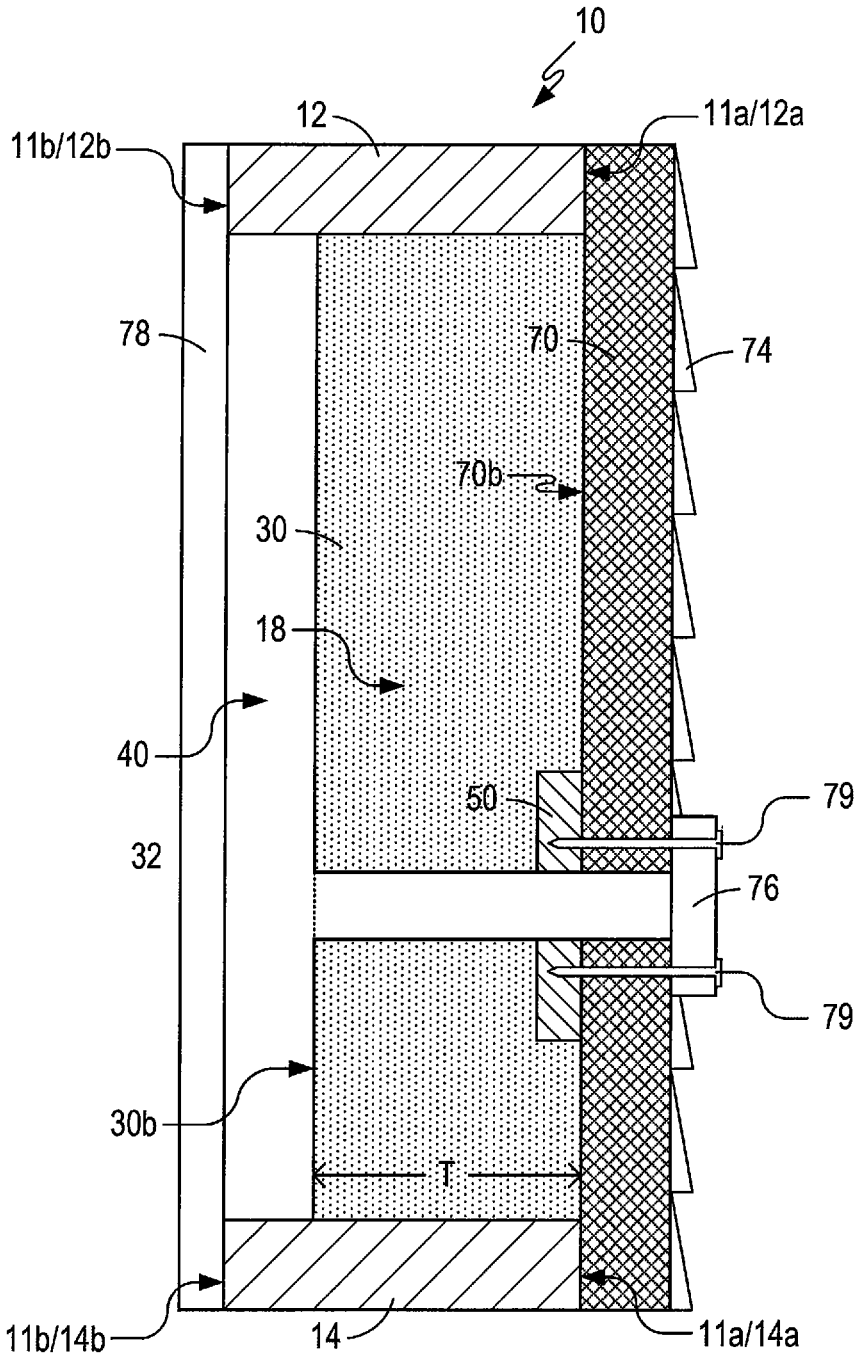
FIG. 8 is a side cross-sectional schematic diagram of a wall structure as shown in FIG. 7 and having exterior siding attached to the sheathing board and an interior wall panel attached to the frame.

For example, referring to FIG. 8, the penetration opening (72/52/32) through the wall structure 10 provides for the connection of exterior fixture 76 to the gap 40. The exterior fixture 76 may be positioned on the front-facing surface 70*a* of the sheathing board 70 (integrated with exterior cladding 74, which may comprise siding, for example). The gap 40 may be located between the rear-facing surface 30*b* of the foam layer 30 and an interior wall panel 78 (which may comprise, for example, drywall, plaster board, or other interior wall cladding). The penetration attachment panel 50 provides increased structural integrity around the penetration opening. The penetration attachment panel 50 also provides a structure having relatively high fastener pull-out strength to which the exterior fixture 76 is attached or otherwise secured with attachment fasteners 79 that penetrate through the sheathing board 70 and engage the penetration attachment panel 50.

Referring to FIGS. 1,2, and 6, the penetration attachment panel 50 is shown as a rectangular-shaped panel with gaps between the vertical edges of the panel 50 and the side members 16. However, it is understood that the shape and dimensions of the penetration attachment panel 50, and its location relative to the side members 16, the first and second members 12 and 14, or any other constituent members of the frame 11, are only limited by the shape and size of the cavity 18 in which the penetration attachment panel 50 is positioned.

Figure 9:
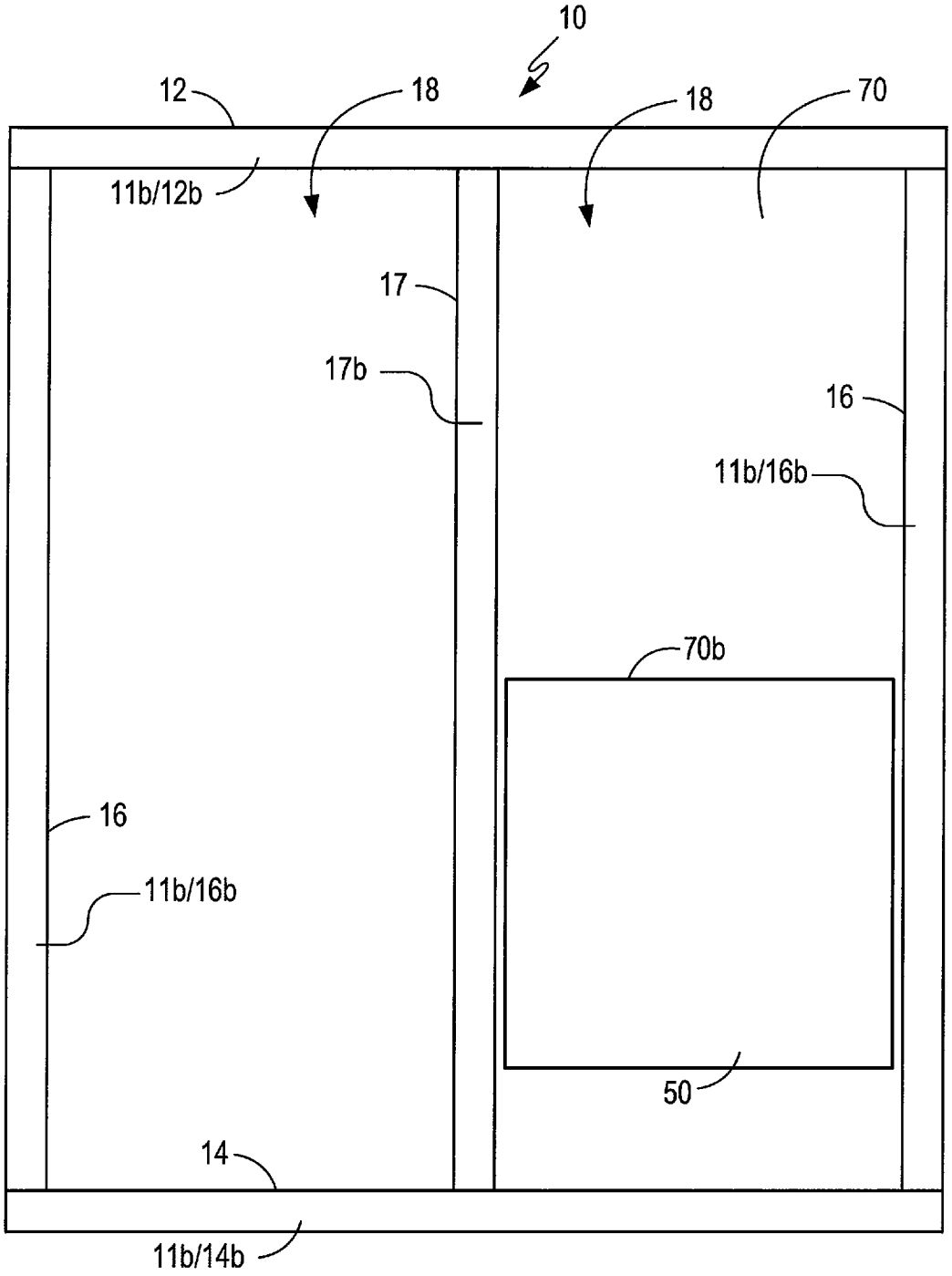
FIG. 9 is a rear view schematic diagram of a wall structure comprising a frame, a sheathing board attached to the frame, and a penetration attachment panel.

For example, referring to FIG. 9, a frame is shown comprising a first member 12, a second member 14 spaced apart from the first member 12, two side members 16 extending between the first member 12 and the second member 14, and a primary support member 17 positioned between the two side members 16 and extending between the first member 12 and the second member 14. The first member 12, the second member 14, and the two side members 16 each comprise a front surface (not shown) and a rear surface (12*b*, 14*b*, and 16*b*, respectively) that collectively form the front frame surface (not shown) and the rear frame surface 11*b*. The primary support member 17 comprises a front primary support surface (not shown) and an opposite rear primary support surface 17*b*. The front primary support surface corresponds to the front frame surface. The rear primary support surface 17*b* corresponds to the rear frame surface 11*b*.

A sheathing board 70 may be attached to the front frame surface and the front primary support surface (not shown). The sheathing board 70, the first member 12, the second member 14, the two side members 16, and the primary support member 17 define cavities 18 within the frame. A penetration attachment panel 50 may be located within one cavity 18 and in contact with the rear-facing surface 70*b* of the sheathing board 70. A foam layer (not shown) may be located within the cavity 18, adhered to the penetration attachment panel 50 and to the sheathing board 70, and encapsulating the penetration attachment panel 50 within the cavity 18. The penetration attachment panel 50 is shown in FIG. 9 with dimensions such that the horizontal edges of the panel 50 may be slightly shorter than the distance between the primary support member 17 and the side member 16 (i.e., panel 50 substantially spans the distance between the primary support member 17 and the side member 16).

The shape and dimensions of a penetration attachment panel, and the location of a penetration attachment panel within a cavity formed by a frame and an attached sheathing board, can be selected based on the size of the cavity, the location of the exterior fixtures to be secured to the penetration attachment panel, and the weight of the exterior fixtures to be secured to the penetration attachment panel.

Figure 10A:
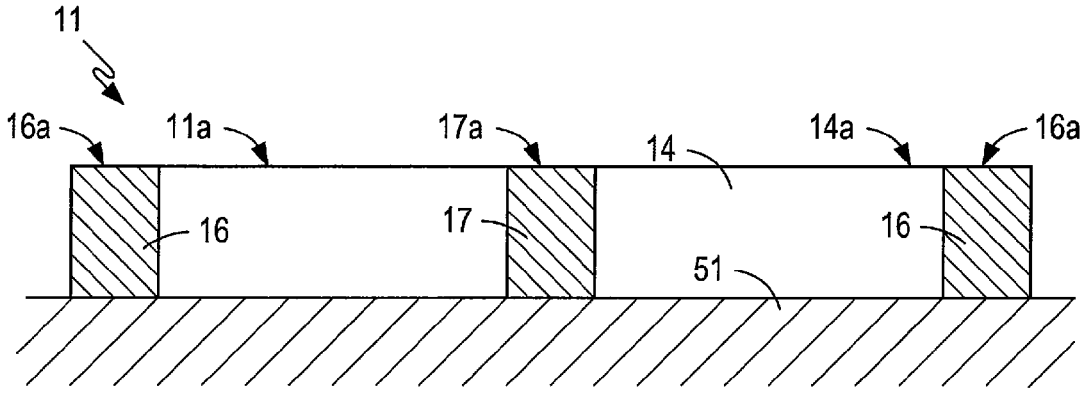
FIGS. 10A-10E are a series of cross-sectional schematic diagrams illustrating the manufacture of a wall structure as shown in FIG. 9.

Referring to FIGS. 10A-10E, a method of manufacturing a wall structure comprises providing a frame 11 as shown in FIG. 10A. The frame 11 comprises a first member (not shown), a second member 14 spaced apart from the first member, two side members 16 extending between the first member and the second member 14, and a primary support member 17 positioned between the two side members 16 and extending between the first member and the second member 14. The first member (not shown), the second member 14, the two side members 16, and the primary support member 17 each comprise a front surface (14*a*, 16*a*, and 17*a*, respectively) and a rear surface (14*b*, 16*b*, and 17*b*, respectively) that collectively form the front frame surface 11*a* and the rear frame surface 11*b*. The frame 11 may be provided on a rigid support surface 51 so that the rear frame surface 11*b* (i.e., the rear surfaces 14*b*, 16*b*, and 17*b* of the second member 14, the two side members 16, and the primary support member 17, respectively) contact the rigid support surface 51.

Figure 10B:
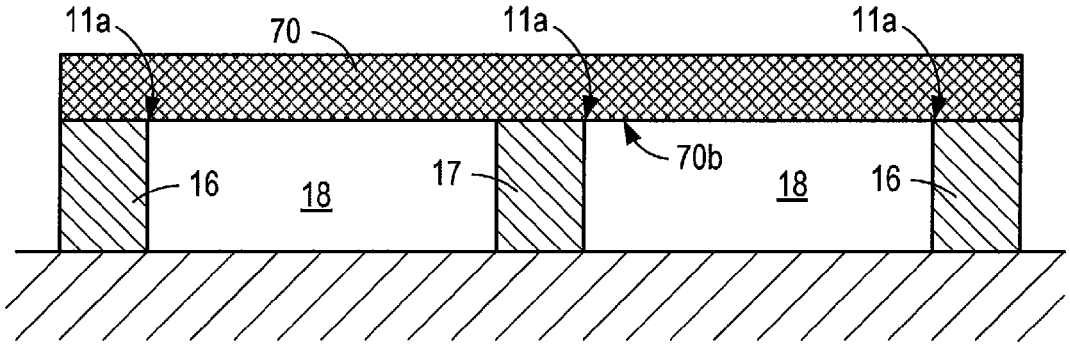

As shown in FIG. 10B, a sheathing board 70 may be attached to the front frame surface 11*a*. The sheathing board 70 may comprise a construction as described above. As also described above, the sheathing board 70 may be attached to front frame surface ha (including any of the front faces of the first and second members, the front faces of the two side members, and the front face of the primary support member) with fasteners (not shown). The fasteners may comprise nails, staples, screws, bolts, or rivets, or a combination of any thereof. Alternatively, or in addition, the sheathing board 70 may be attached to front frame surface 11*a* (including any of the front faces of the first and second members, the front faces of the two side members, and the front face of the primary support member) with an adhesive (not shown). For example, a layer of foam may be deposited onto the rear-facing surface 70*b* of the sheathing board 70 before attaching the sheathing board 70 to the front frame surface 11*a*.

Figure 10C:
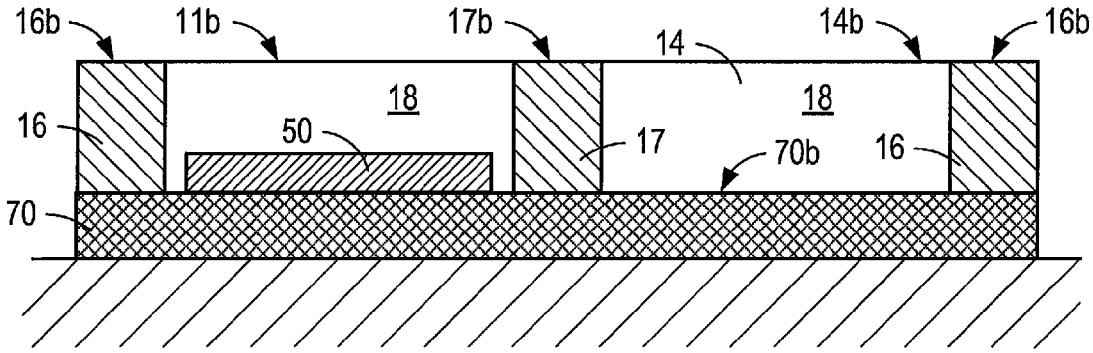

The sheathing board 70, the first member (not shown), the second member 14, the two side members 16, and the primary support member 17 define cavities 18 within the frame 11. Although FIGS. 10A-10E show the frame 11 comprising the primary support member 17, which results in two cavities 18, it is understood that the primary support member 17 could be omitted from the frame 11, in which case a single cavity 18 within the frame 11 would be defined by the first member (not shown), the second member 14, and the two side members 16 (see FIGS. 1-3). In addition, two or more primary support members may be included within a frame, thereby defining three or more cavities. Referring to FIG. 10C, the frame structure and the attached sheathing board may be rotated 180 degrees through the horizontal plane so that the sheathing board contacts the rigid support surface. A penetration attachment panel 50 may be positioned within one of the cavities 18 and in contact with the rear-facing surface 70*b* of the sheathing board 70.

The penetration attachment panel 50 can be positioned within the cavity 18 as described above. For example, the positioning of the penetration attachment panel 50 may not comprise attaching the panel 50 to the sheathing board 70, and may comprise just physically positioning the panel 50 on the rear-facing surface 70*b* of the sheathing board 70, in which case the panel 50 is held in place by gravity and friction. Alternatively, the positioning of the penetration attachment panel 50 may comprise attaching the panel 50 to the sheathing board 70 using an adhesive. For example, a layer of foam may be deposited onto the rear-facing surface 70*b* of the sheathing board 70 before positioning the penetration attachment panel 50 within the cavity 18 and in contact with the rear-facing surface 70*b* of the sheathing board 70. Also, as described above, the penetration attachment panel 50 can optionally be positioned on the sheathing board 70 using one or more positioning devices (not shown) that engage but do not penetrate through the sheathing board 70.

Figure 10D:
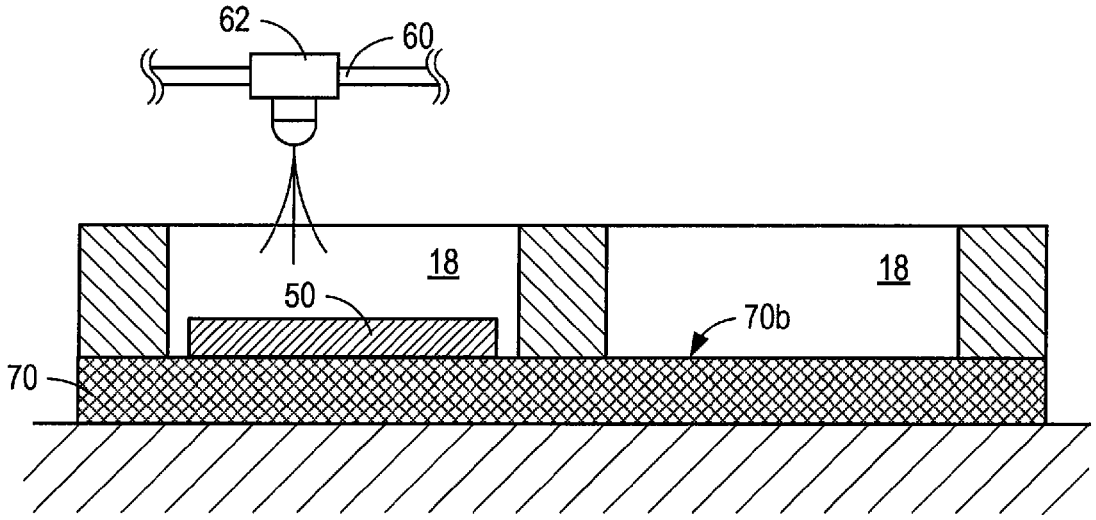
Figure 10E:
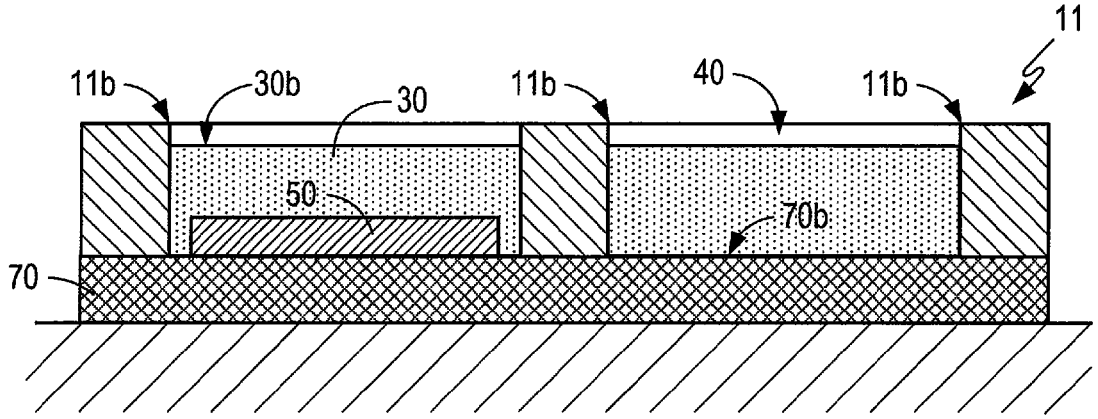

Referring to FIG. 10D, a foam layer may be deposited into the cavities 18. The foam may be deposited from a foam dispensing rig 60, which can include one or more nozzles 62 (however, it is understood that the foam can be deposited using any suitable operation such as, for example, manually using a foam spray gun). Referring to FIG. 10E, the deposited foam layer 30 covers the penetration attachment panel 50 and the sheathing board 70 in the cavity 18. The foam layer 30 may be deposited to a thickness extending from the rear-facing surface 70*b* of the sheathing board 70 to a position intermediate the front frame surface 11*a* and the rear frame surface 11*b* such that a gap 40 may be formed within the frame 11 between the rear-facing surface 30*b* of the foam layer 30 and the rear frame surface 11*b*. It is understood, however, that the foam layer 30 can alternatively be deposited to a thickness extending from the rear-facing surface 70*b* of the sheathing board 70 to the rear frame surface 11*b*, in which case no gap is formed within the frame 11 between the rear-facing surface 30*b* of the foam layer 30 and the rear frame surface 11*b*. The deposited foam layer 30 can be cured so that the foam layer solidifies and adheres to the penetration attachment panel 50 and the sheathing board 70, and encapsulates the penetration attachment panel 50.

The wall structures described in this specification comprise a penetration attachment panel embedded within the wall structure (encapsulated by the foam layer and the sheathing board). The embedded penetration attachment panel provides increased structural integrity for attaching or otherwise securing exterior fixture to the wall structure. To connect exterior fixtures to interior spaces, a penetration opening must be formed through the sheathing board, the penetration attachment panel, and the foam layer (see FIG. 8). A penetration opening that connects a front-facing surface of the sheathing board and a rear-facing surface of the cured foam layer can be formed (e.g., drilled, sawed, or otherwise cut-out) as part of the manufacturing process of pre-fabricated wall structures after the foam layer cures. Alternatively, the internal location of the embedded penetration attachment panel can be marked on either or both of the front-facing surface of the sheathing board or the rear-facing surface of the cured foam layer, and builders can form (e.g., drill, saw, or otherwise cut-out) penetration openings on-site at a construction site.

Figure 12:
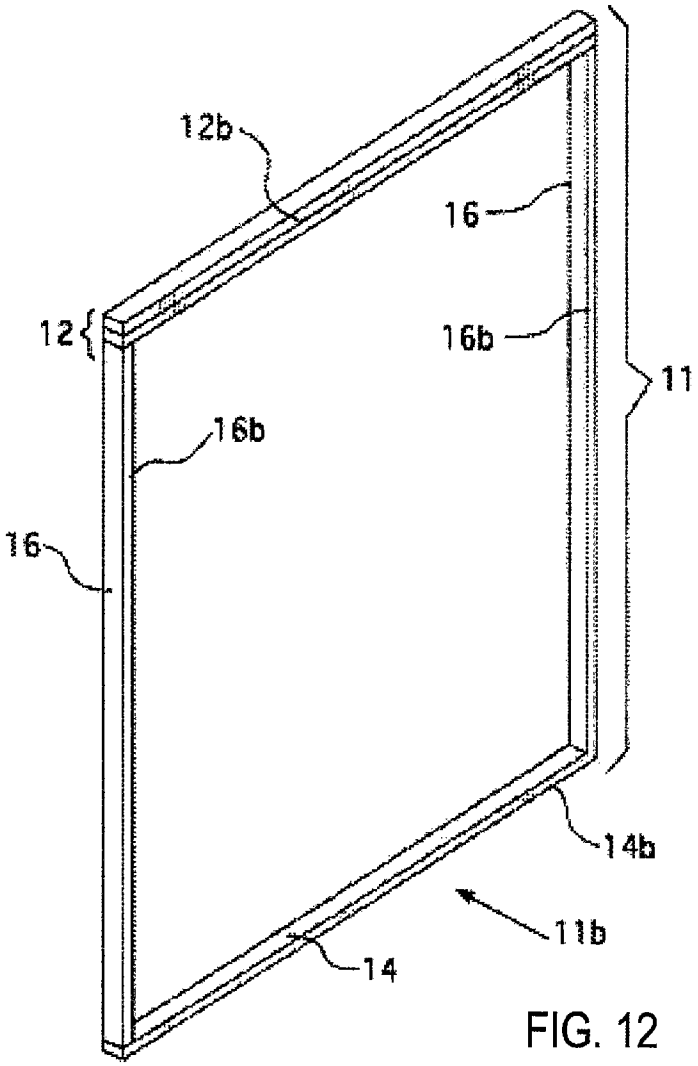
FIG. 12 is a rear perspective view of the wall structure frame shown in FIG. 11.
Figure 11:
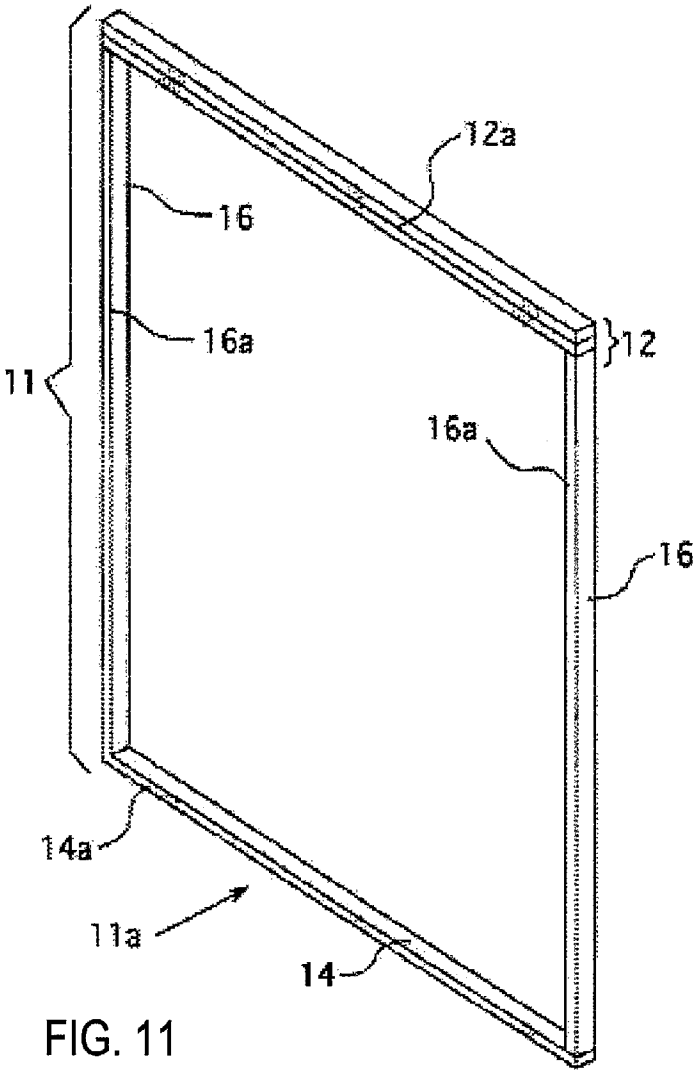
FIG. 11 is a front perspective view of a wall structure frame.

FIGS. 11-23 illustrate additional features of the wall structures and the methods of manufacturing the wall structures described in this specification. For example referring to FIGS. 13 and 14, a wall structure 10 includes a frame 11, at least one primary support member 17, a sheathing board 70, a foam layer 30, and a penetration attachment panel (not shown) located between the sheathing board 70 and the foam layer 30. As shown in FIGS. 11 and 12, the frame 11 may be defined by a first member 12, a second member 14 spaced apart from the first member 12, and two side members 16 extending between the first member 12 and the second member 14. The first member 12, the second member 14, and the two side members 16 each have a front surface 12*a*, 14*a*, 16*a* and a rear surface 12*b*, 14*b*, 16*b* that define a front frame surface 11*a* and a rear frame surface 11*b*, respectively.

The frame 11 can be constructed into different shapes depending on its intended use. For example, as shown in FIGS. 11 and 12, the frame 11 can be constructed as a conventional industry standard rectangular or square frame 11. The first member 12 and the second member 14 may be spaced apart and extend parallel to each other, and the two side members 16 may extend perpendicular to the first member 12 and the second member 14 so as to from a rectangular or square frame 11. The shape and design of the frame 11 is not so limited and can be constructed into any desired shape. Generally, the shape and design of the frame 11 is constructed in accordance with the floor plans designed for a particular home or building.

Figure 14:
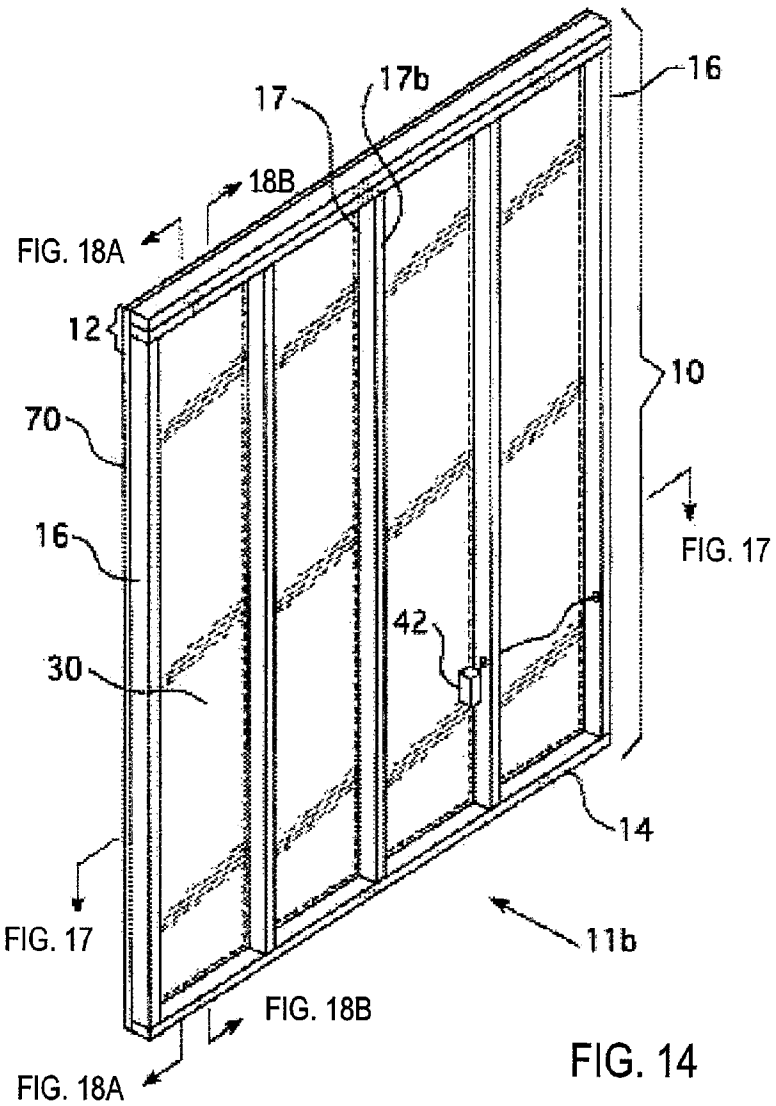
FIG. 14 is rear perspective view of the wall structure shown in FIG. 13.
Figure 13:
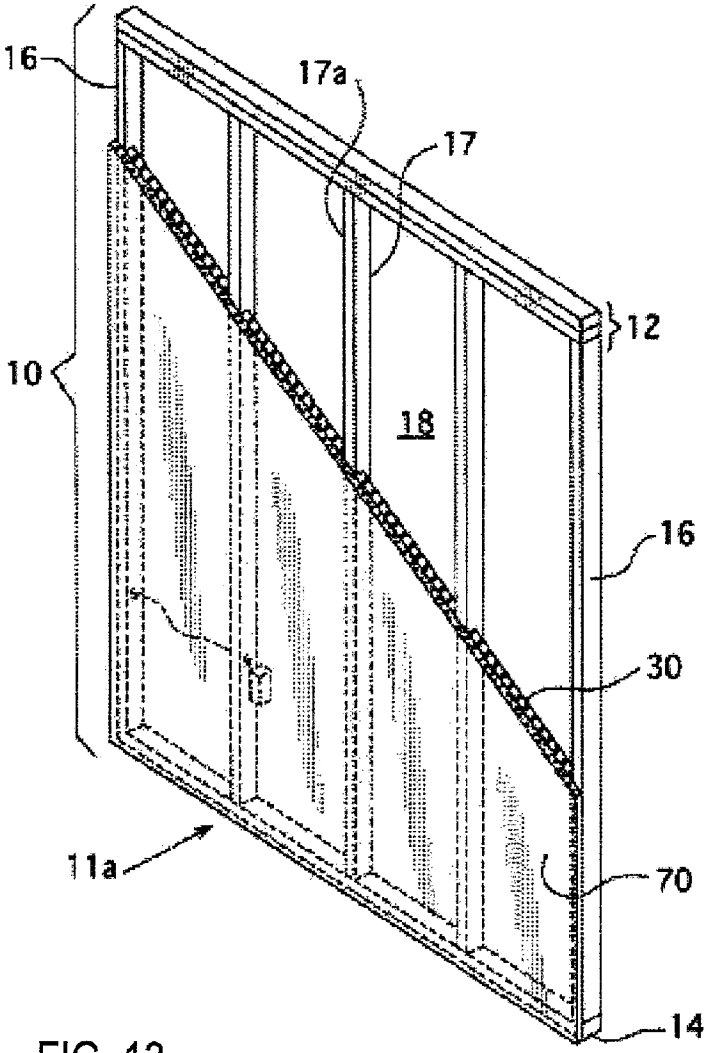
FIG. 13 is a front perspective view of a wall structure comprising a sheathing board and a foam layer shown in partial cut-away.

Referring to FIGS. 13 and 14, at least one primary support member 17 may be positioned between the two side members 16. The primary support members 17 may extend between the first member 12 and the second member 14. The primary support members 17 may define a front primary support surface 17*a* and a rear primary support surface 17*b*. As shown in FIGS. 13 and 14, the front primary support surface 17*a* and the rear primary support surface 17*b* correspond to the front frame surface 11*a* and the rear frame surface 11*b* of the frame 11. The primary support members 17 may be spaced apart to form cavities 18. The cavities 18 may be defined by the space formed within the frame 11 between the primary support members 17, the side members 16, the first member 12, and/or the second member 14. The size of each cavity 18 can vary based on the size of the frame 11, the distance between consecutively positioned primary support members 17, and the number of primary support members 17 present. The primary support members 17, the side members 16, the first member 12, and/or the second member 14 may comprise one or more plates, boards, beams, studs, or the like. For example, as shown in FIGS. 11-14, the first member 12 may include two beams.

The two side members 16 and/or the primary support members 17 may be fixedly engaged to the first member 12 and the second member 14. For example, the two side members 16 and/or the primary support members 17 may be fixedly engaged to the first member 12 and the second member 14 with fasteners. Suitable fasteners include, but are not limited to, nails, nail plates, staples, bolts, screws, and rivets. The first member 12, the second member 14, the two side members 16, and the primary support members 17 can be made of various materials. For example, the first member 12, the second member 14, the two side members 16, and the primary support members 17 can be made of wood, metal, fiberglass, plastic, wood-polymer composite materials, or a combination of any thereof. The first member 12, the second member 14, the two side members 16, and the primary support members 17 can be made of the same material or different materials.

The dimensions of the first member 12, the second member 14, the two side members 16, and the primary support members 17 can vary depending on the intended use of the frame 11. The first member 12, the second member 14, the two side members 16, and the primary support members 17 can each have any dimension. The first member 12, the second member 14, the two side members 16, and the primary support members 17 can have the same dimensions. For example, the first member 12, the second member 14, the two side members 16, and the primary support members 17 may have the same thickness and width dimensions, and the same or different length dimensions. For example, the first member 12, the second member 14, the two side members 16, and the primary support members 17 can all have a thickness and width and height dimension of nominally 2×4 inches. In another example, the first member 12, the second member 14, the two side members 16, and the primary support members 17 can all have thickness and width dimensions of nominally 2×6 inches.

The first member 12, the second member 14, and the two side members 16 can have the same dimensions, which may be different than the dimensions of the primary support members 17. For example, the first member 12, the second member 14, and the two side members 16 may have the same thickness and width dimensions, and the primary support members 17 may have thickness and/or width dimensions that may be different than the dimensions of the first member 12, the second member 14, and the two side members 16. For example, the first member 12, the second member 14, and the two side members 16 can have thickness and width dimensions of nominally 2×6 inches, and the primary support members 17 can have thickness and width dimension of nominally 2×4 inches.

Figure 16:
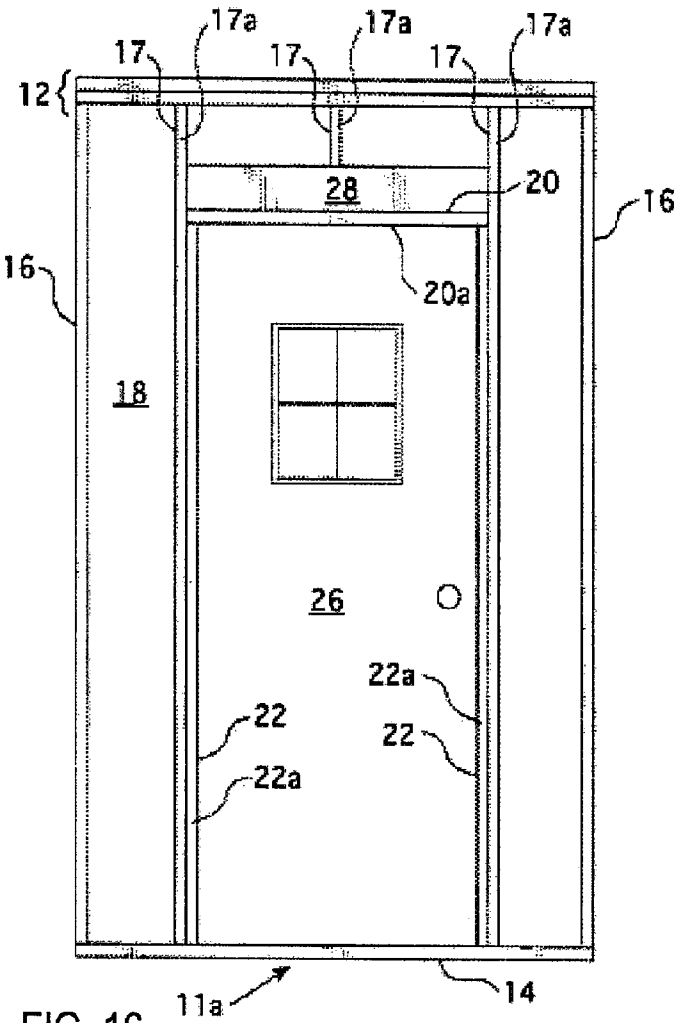
FIG. 16 is a front view of a wall structure frame with a door.
Figure 15:
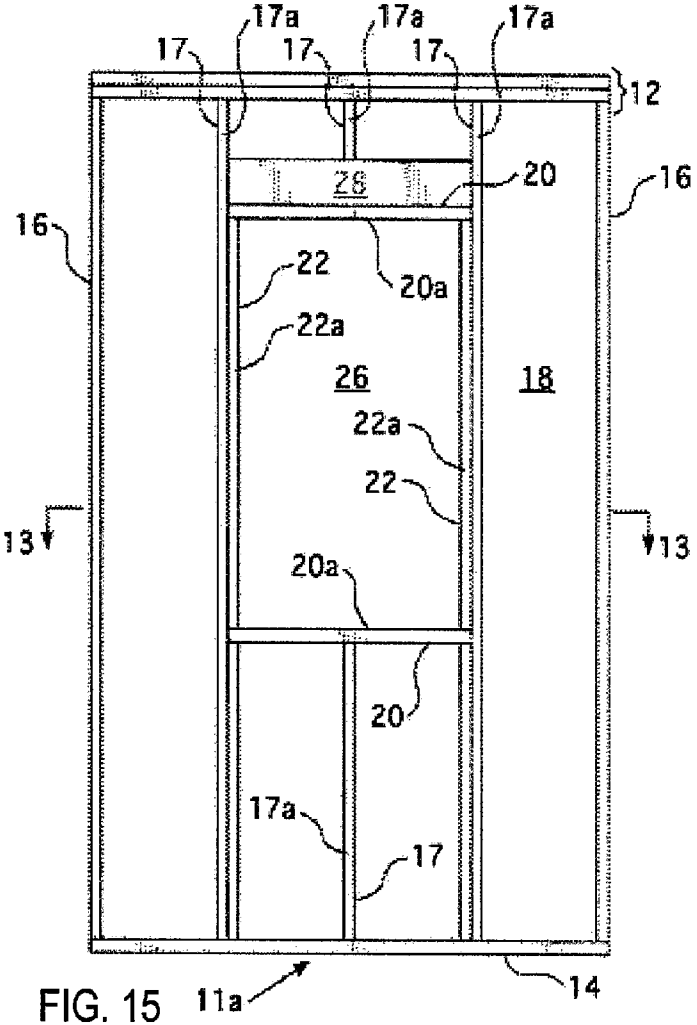
FIG. 15 is a front view of a wall structure frame with a window opening.

Referring to FIGS. 15 and 16, a wall structure can comprise one or more secondary support members 20, and/or tertiary support members 22. The secondary support members 20 and the tertiary support members 22 may comprise one or more plates, boards, beams, studs, or the like. The secondary support members 20 and the tertiary support members 22 can be incorporated into the frame 11 to provide additional structural support, for example, to form spaces for windows, doors, and the like. The secondary support members 20 and the tertiary support members 22 can have dimensions that are the same as or different than the primary support members 17, the side members 16, the first member 12, and/or the second member 14. For example, the secondary support member 20 and the tertiary support members 22 can have shorter lengths than the primary support members 17, the side members 16, the first member 12, and/or the second member 14.

As shown in FIGS. 15 and 16, the secondary support members 20 may have a front secondary support surface 20*a* and a rear secondary support surface (not shown) that correspond with the front and rear frame surfaces 11*a* and 11*b*, and the front and rear primary support surfaces 17*a* and 17*b*. Similarly, the tertiary support members 22 may have a front tertiary support surface 22*a* and a rear tertiary support surface 22*b* (see FIG. 23) that correspond with the front and rear frame surfaces 11*a* and 11*b* and the front and rear primary support surfaces 17*a* and 17*b*.

The secondary support members 20 extend between and attach to the primary support members 17, or alternatively, the secondary support members 20 extend between and attach to a primary support member 17 and a side member 16. The tertiary support members 22 extend between two secondary support members 20 or between a secondary support member 22 and the first member 12 and/or the second member 14.

The secondary support members 20, the tertiary support members 22, the primary support members 17, the side members 16, the first member 12, and/or the second member 14 form a secondary cavity 26. As shown in FIGS. 15 and 16, the secondary cavity 26 can be used as a space for a window, a door, or any other opening. For example, the secondary support members 20, the tertiary support members 22, the primary support members 17, the side members 16, the first member 12, and the second member 14 can be constructed as a conventional industry standard rectangular or square wall panel having a window, door, or any other opening. For example, referring to FIG. 15, a rectangular or square wall structure having a window can be formed as follows: a first member 12 and a second member 14 may be spaced apart and extend parallel to each other; two side members 16 may extend between the first member 12 and the second member 14 in a direction perpendicular to the first member 12 and the second member 14; primary support members 17 may be positioned between the side members 16 and extend between the first member 12 and the second member 14 in a direction perpendicular to the first member 12 and the second member 14; two secondary support members 20 may be spaced apart and extend between the primary support members 17 in a direction parallel to the first member 12 and the second member 14; and two tertiary support members 22 may be spaced apart and extend between the two secondary members 20 in a direction perpendicular to the secondary support members 20 and the first member 12 and the second member 14. In addition, the primary support members 17 can also extend between the secondary members 20 and the first member 12 and/or the second member 14. As shown in FIG. 15, a secondary cavity 26 may be formed between the secondary support members 20 and the tertiary support members 22. The resulting rectangular or square wall panel can be used in a residential home or building. The shape and design of the frame 11 of the wall structure 10 is not so limited and can assume any shape and design as desired.

Additional support members and structural elements may also be used depending on the intended use of the wall structure 10. For example, and as shown in FIGS. 15 and 16, a header 28 may be used to provide additional support for a door or window. Other additional support members may be used for structural purposes, design purposes, and the like.

Figure 18B:
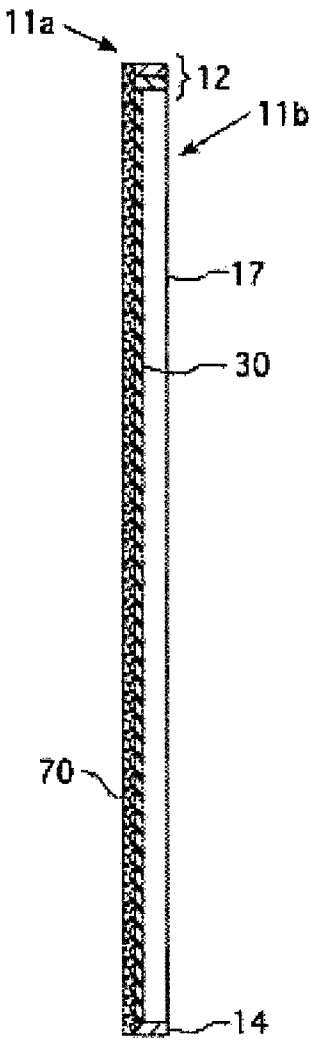
FIG. 18B is a side cross-sectional view of the wall structure shown in FIGS. 13 and 14.
Figure 18A:
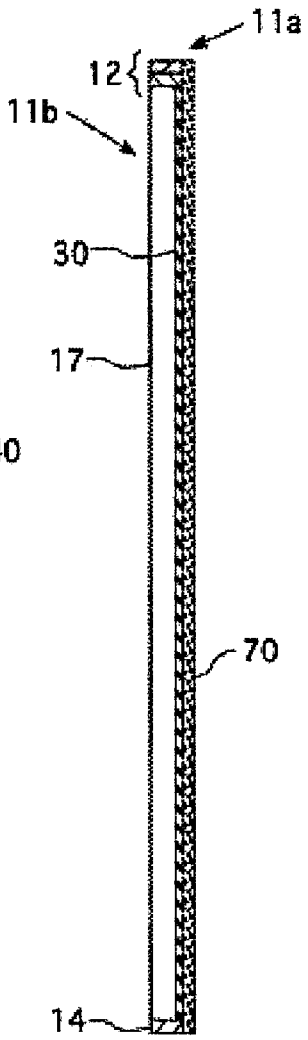
FIG. 18A is a side cross-sectional view of the wall structure shown in FIGS. 13 and 14.
Figure 17:
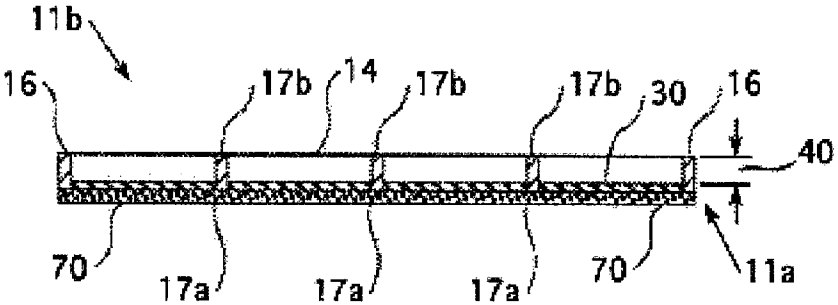
FIG. 17 is a top cross-sectional view of the wall structure shown in FIGS. 13 and 14.

Referring to FIGS. 17, 18A, and 18B, a sheathing board 70 may be attached to at least a portion of the front frame surface. As described above, the sheathing board 70 can comprise a polyiso board, an expanded polystyrene board, an extruded polystyrene board, a gypsum board, a cement board, an adhesive-bonded and laminated cellulosic fiberboard (e.g., a Thermo-Ply® board), an asphalt-impregnated cellulosic fiberboard (e.g., a Celotex® board), a thermoset resin-wood composite board, a thermoset resin-mineral wool composite board (e.g., a Roxul® board, or a T1-11 siding board.

In one specific example, the sheathing board 70 comprises a polyiso board. Compared to polyurethane foams, polyiso foams have a much higher isocyanate content. Through the use of certain catalysts the isocyanate is able to react with itself forming a ring-like structure (polyisocyanurate) that is very stable. Polyiso boards typically have a thickness which varies depending on the application. For example, a polyiso board can have a thickness of about ½-inch to about 3-inches, or any sub-range subsumed therein such as, for example, about ¾-inch to about 2-inches. The polyisocyanurate foam layer of a polyiso board may have a front face and a rear face, as described above.

The sheathing board may be attached to the front frame surface by various attachment mechanisms. For example, the sheathing board can be attached to the front frame surface by fasteners. The fasteners used to attach the sheathing board to the front frame surface are not necessarily the same as the fasteners used to engage the first and second members, as described above. Suitable fasteners may include nails, staples, screws, bolts, or rivets, or a combination of any thereof. Because sheathing boards comprise polyisocyanurate foam or other materials having relatively low fastener pull-out strength, care must be used when mechanically fastening sheathing boards to frames so as not to damage the sheathing boards.

Alternatively, the sheathing board can be attached to the front frame surface by the use of one or more adhesives. The adhesives may be selected from latex-based adhesives, reactive hot melts, polyester adhesives, polyamide adhesives, acrylic adhesives, one-component epoxy-based adhesives, one-component polyurethane-based adhesives, two-component polyurethane-based adhesives, and combinations of any thereof. Also, as described below, a foam material may be used as the adhesive. For example, a layer of foam may be applied to the sheathing board, the front frame surface, or both, before positioning and attaching the sheathing board to the front frame surface.

As described above, sheathing boards generally comprise facers on both sides of the core layer, which may be the same or different. As also described above, examples of suitable facer materials include, but are not limited to, fiberglass mats, glass fiber-reinforced cellulosic felts, coated and polymer-bonded fiber mats (e.g., fibrous glass mats bonded with an organic polymer binder and coated with an organic polymer coating, clay, or other inorganic coating), foils (e.g., aluminum foil), coated foils, foil/membrane laminates, foil/glass composites, and polyolefin films (such as TYVEK® materials, available from DuPont; or TYPAR® materials, available from Fiberweb, Inc.). The sheathing board may comprise a facer material attached to at least a portion of the front face and/or the rear face of the core layer. The facer material can cover the entire surface of the front face or the rear face or both the front and rear faces of the core layer. The facer material may advantageously promote adhesion of the foam layer 30 to the sheathing board 70. As described above, the facer material on the front face may be the same as or may be different than the facer material on the rear face.

The sheathing board 70 attached to the frame 11 may comprise multiple separate sheathing boards (i.e., multiple sections) which may be joined together by tape or caulk or polyurethane foam to form the sheathing board 70.

The foam layer 30, which adheres to the sheathing board and encapsulates the penetration attachment panel, comprises a foam material deposited into the frame 11. Again, as used in this specification, the term "foam material" refers to a substance that is formed by trapping pockets of gas in a liquid or solid. For example, a foam material can be a "closed-cell foam," which as used in this specification refers to foam that contains discrete, non-interconnecting cells. Examples of foam material that can be used with the present invention include foam materials made with polyurethane, polyisocyanurate (also referred to as polyiso, as described above), and mixtures thereof. As described above, the foam material may be substantially free, may be essentially free, and may be completely free of halogen containing flame retardant additives.

As shown in FIGS. 13, 14, 17, 18A, and 18B, the foam material can be deposited into the frame 11 such that the foam material forms a foam layer 30 within at least a portion of the frame 11 between the front frame surface 11*a* and the rear frame surface 11*b*, and adheres to the sheathing board 70, and encapsulates the penetration attachment panel (not shown).

Referring to FIGS. 17, 18A, and 18B, the foam layer 30 can be dimensioned to expand to a position intermediate the front frame surface 11*a* and the rear frame surface 11*b*, thereby forming a gap 40 within the wall structure 10 between the foam layer 30 and the rear frame surface 11*b*. FIGS. 13 and 14 further show that the gap 40 can be used as an area to incorporate home utility components 42 such as electrical wires, cords, heating and cooling pipes, and plumbing fixtures (which may be further positioned through a penetration opening (not shown) in the foam layer 30, the sheathing board 70, and a penetration attachment panel (not shown)). These home utility components may be inserted into the gap 40 located between the foam layer 30 and the rear frame surface 11*b* such that utilities components are not surrounded by or contacting the foam layer 30 (other than portions located in a penetration opening (not shown) connected to the exterior-facing surface of the sheathing board). In one example, the gap 40 can comprises at least two inches as measured between the foam layer and the rear frame surface 14.

Figure 19:
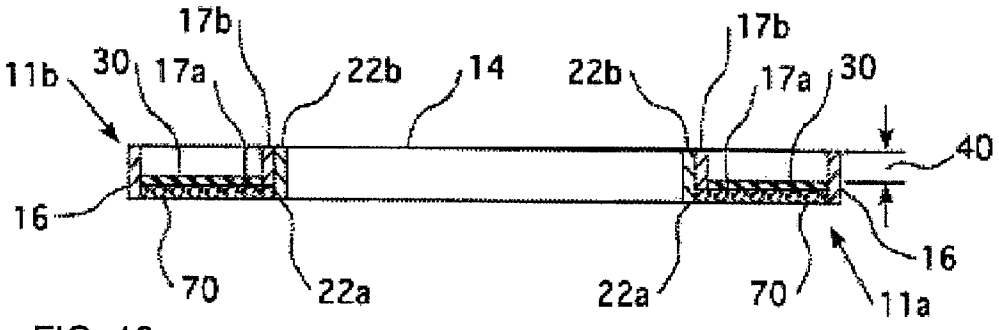
FIG. 19 is a top cross-sectional view of a wall structure.

When secondary support members 20 and/or tertiary support members 22 are used with the foam wall structure 10 to form a secondary cavity 26, the secondary cavity 26 can be free of foam. For example, the foam layer 30 does not extend beyond and over the front secondary support surfaces 20*a* of the secondary members 20, the front tertiary support surfaces 22*a* of the tertiary support members 22, and/or beyond and over at least a portion of the front surfaces of other members that help form the secondary cavity 26. FIG. 19, for example, shows a top cross-sectional view with the foam layer 30 not extending beyond the front tertiary support surface 22*a* of the tertiary members 22. In such cases, corresponding openings may also be present in the sheathing board 70.

The foam layer 30 can be formed in-situ during the manufacturing process. The term "formed in-situ during the manufacturing process," as used in this specification, refers to the formation of a foam layer 30 as described in this specification during manufacturing of the foam wall structure 10 off-site at a facility remote or away from a building construction site. As such, the foam layer 30 may be formed not at a construction site as is required by conventional methods, but instead as a component of the pre-fabricated wall structure 10.

The foam layer 30 is able to fill tight spaces and seal gaps that may not be visible to the naked eye. The foam layer 30 can also act as a vapor and thermal insulating barrier, which reduces energy consumption in buildings and residential homes when the wall structure 10 is used as a constituent wall panel. The foam layer 30 may provide structural stability to the wall structure 10, such as improved wall racking strength, which refers to the ability of a wall structure to maintain its shape under shear stress. Additionally, as described above, the foam layer 30 may encapsulate a penetration attachment panel, which secures the panel in place relative to the exterior-facing surface of the sheathing board and provides a location for the attachment of exterior fixtures.

The present invention is also directed to methods of manufacturing a wall structure 10. A method of making a wall structure 10 includes providing a frame 11, optionally having at least one primary support member 17. The frame 11 optionally having at least one primary support member 17 can be constructed in accordance with any of the examples described in this specification and shown in the drawings (see, for example, FIGS. 13-19). A sheathing board 70 is attached to the frame 11 at the front frame surface 11*a*, as described above.

Referring to FIGS. 20-23, after constructing or otherwise providing the frame 11, optionally with at least one primary support member 17, and attaching a sheathing board 70, the front frame surface 11*a* can be orientated over a rigid surface 51 such that the front frame surface 11*a* is positioned parallel or at least substantially parallel to the rigid surface 51. A "rigid surface" refers to any surface that is capable of receiving the frame 11 without bending, flexing, or moving. As shown in FIGS. 20-23, the rigid surface 51 has a width equal to or greater than the width of the front frame surface 11*a* and a length equal to or greater than the length of the front frame surface 11*a*. The rigid surface 51 may be positioned horizontally (as shown), vertically, or at an angle ranging from zero degrees to 90-degrees from the horizontal.

After orientating the front frame surface 11*a* over the rigid surface 51, a penetration attachment panel (not shown) may be positioned within a cavity 18 in the frame 11 and in contact with a rear-facing surface of the sheathing board, as described above, and a foam material may be deposited into the frame 11. The foam material may be deposited into the frame 11 with an automated delivery device. Alternatively, the foam may be deposited into the frame 11 using various other devices including, but not limited to, a foam dispensing gun that is controlled and carried by an individual user. As shown in FIGS. 20-23, the foam material may be deposited into the frame 11 with an automated foam dispensing rig 60 that can be calibrated to dispense a predetermined amount of foam. The foam dispensing rig 60 can include one or more nozzles 62. The nozzles 62 can be positioned over the frame 11 of the wall structure 10 so that each nozzle 62 sprays or pours foam into cavities 18 located within the frame 11 such as the cavities 18 shown in FIG. 20. A foam dispensing rig 60 with a plurality of nozzles 62 makes it possible to dispense foam quickly and efficiently. The nozzles 62 can controllably move into different positions.

Figure 20:
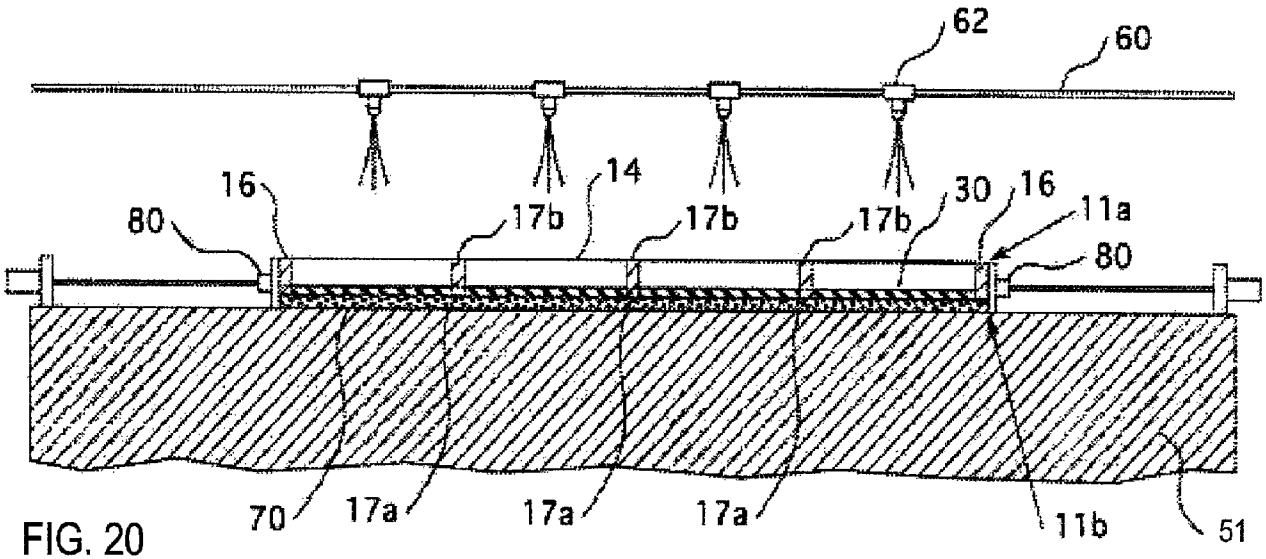
FIG. 20 is a top cross-sectional view of foam material being deposited into a frame.
Figure 21:
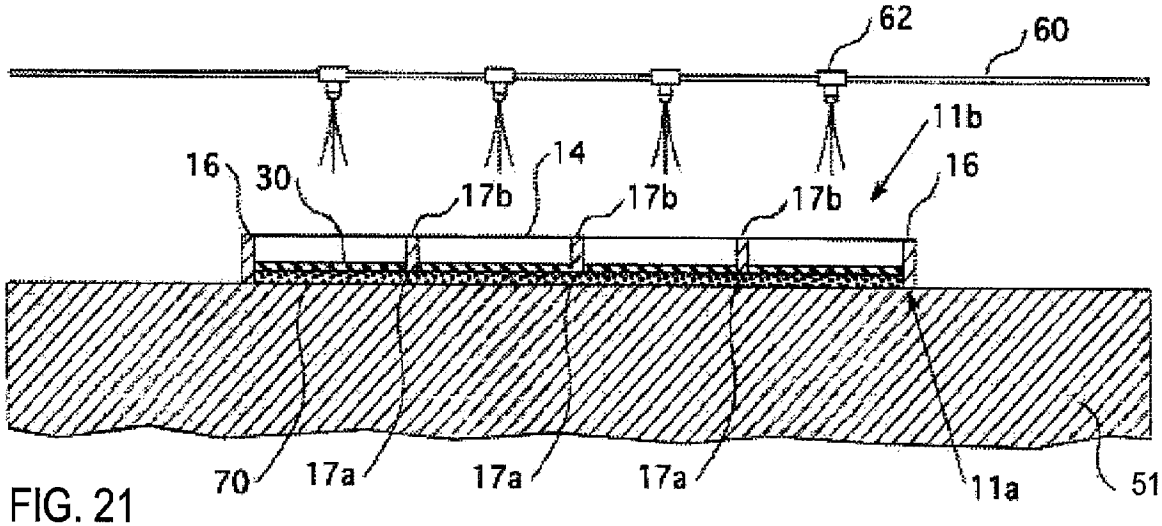
FIG. 21 is a top cross-sectional view of foam material being deposited into a frame.

Still referring to FIGS. 20-23, the foam material may be deposited into the frame 11 so that the foam material contacts the rear-facing surface of the sheathing board 70 and the penetration attachment panel (not shown). As shown in FIG. 20, the foam material may be deposited so that the foam layer 30 extends beyond the front primary support surfaces 17*a* and the front frame surface 11*a*. Alternatively, as shown in FIG. 21, the foam material may be deposited into the frame 11 so that the foam layer 30 does not extend beyond the front frame surface 11*a*. Accordingly, the foam material can be deposited into the frame 11 so that a foam layer 30 forms and may be flush with the front frame surface 11*a* or contained between the front frame surface 11*a* and the rear frame surface 11*b*.

Figure 22:
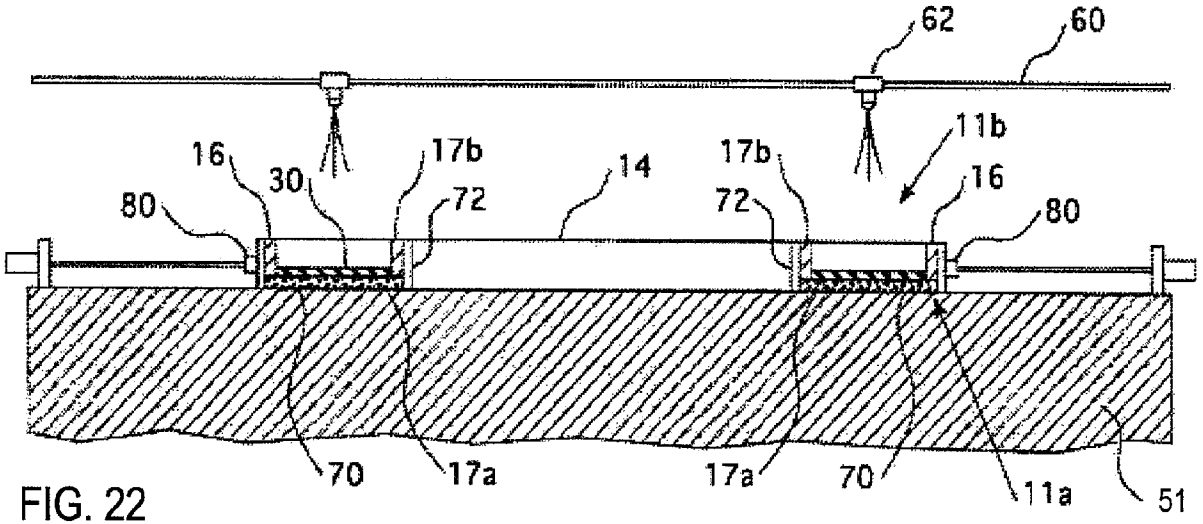
FIG. 22 is a top cross-sectional view of foam material being deposited into a frame.

As shown in FIGS. 20 and 21, the foam material can be deposited into the frame 11 so that the foam layer 30 can expand to a position intermediate the front frame surface 11*a* and rear frame surface 11*b*. A gap or opening 40 can therefore be formed between the foam layer 30 and the rear frame surface 11*b* to incorporate home utility components 42 such as electrical wires, cords, heating and cooling pipes, and plumbing fixtures, as can be seen in FIGS. 13 and 14. As shown in FIG. 22, a barrier 72 may be positioned between adjacent primary support members 17 to prevent foam material from expanding into undesired areas (e.g., window or door opening). A clamp 80 may be placed around the perimeter of the frame 11 hold the frame while the foam is deposited inside the frame 11.

As shown in FIG. 21, the front frame surface 11*a* can be placed over the rigid surface 50 without elevating the frame 11. The foam material can be deposited into the frame 11 such that a foam layer 30 is formed flush with the front primary support surfaces 17*a* and not the front frame surface 11*a*.

Figure 23:
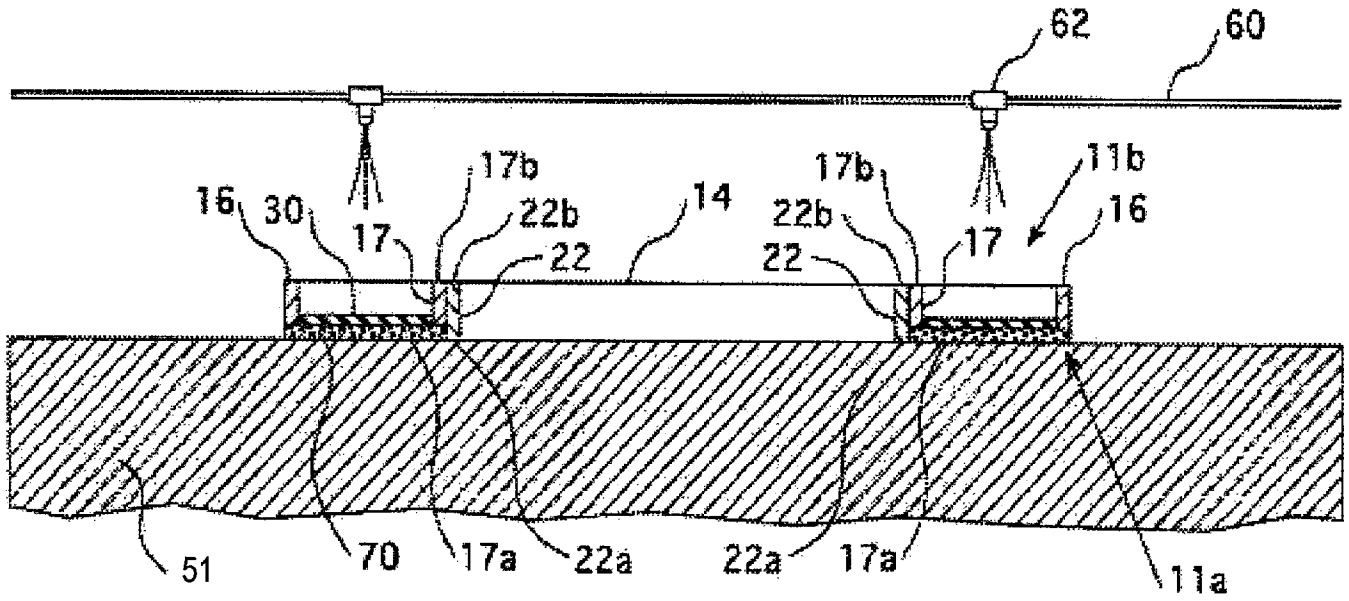
FIG. 23 is a top cross-sectional view of foam material being deposited into a frame.

As described above, the wall structure 10 can also include secondary support members 20 and tertiary support members 22 that form a secondary cavity 26 within the frame 11. The described methods therefore include constructing or otherwise providing a frame 11 having one or more secondary support members 20 and tertiary support members 22. As shown in FIG. 23, to prevent deposited foam material from entering the secondary cavity 26, the dimensions of the secondary support members 20 and/or tertiary support members 22 have a greater height than the primary support members 17.

After the foam layer 30 has expanded and cured, the wall structure 10 can be removed from the rigid surface 51 and shipped to a job site for use as a wall panel. Accordingly, the present invention is also directed to a pre-fabricated wall panel comprising the wall structure described in this specification.

The wall structure can be installed without any additional steps, thereby reducing the number of sub-contractors necessary to complete the installation of a wall at a construction site. In addition, the wall structure does not require additional materials such as exterior OSBs, and house wrap that are typically used in current residential building practices. Therefore, the wall structures described in this specification decrease construction costs. The wall structures also decrease the overall cost per square foot per R-value.

The wall structures described in this specification also can impart a higher wall racking strength and improve thermal performance in comparison to existing wall solutions through the combination of the foam layer and the sheathing board. Further, the wall structures described in this specification can help meet future R-value industry standards that are expected to increase in certain regions. With current fiberglass insulation, builders would have to convert 2×4-based wall designs to 2×6-based wall designs to ensure enough wall cavity capacity for additional insulation to meet such higher standards.

The wall structures described in this specification can also improve the consistency of installed insulation, and make it easy to install electrical and plumbing components, including components connected to exterior fixtures. The wall structures described in this specification can be used in new building construction or in retrofit or repair applications.

EXAMPLES

Various features and characteristics of examples of the invention include, but are not limited to, the following numbered clauses:

1. A wall structure comprising: a frame comprising: a first member; a second member spaced apart from the first member; and two side members extending between the first member and the second member, wherein the first member, the second member, and the two side members each comprise a front surface and a rear surface that form a front frame surface and a rear frame surface; a sheathing board attached to the front frame surface, and wherein the sheathing board, the first and second members, and the two side members define a cavity within the frame; a penetration attachment panel located within the cavity and in contact with a rear-facing surface of the sheathing board; and a foam layer located within the cavity, wherein the foam layer adheres to the penetration attachment panel and the sheathing board, and wherein the foam layer encapsulates the penetration attachment panel.

2. The wall structure of clause 1, further comprising a primary support member positioned between the two side members and extending between the first member and the second member, wherein the primary support member comprises a front primary support surface and an opposite rear primary support surface, and wherein the front primary support surface corresponds to the front frame surface.

3. The wall structure of clause 2, wherein the rear primary support surface corresponds to the rear frame surface.

4. The wall structure of clause 2 or clause 3, wherein the sheathing board is attached to the front frame surface and the front primary support surface.

5. The wall structure of any one of clauses 2-4, wherein the sheathing board, the first and second members, one of the two side members, and the primary support member define the cavity within the frame.

6. The wall structure of any one of clauses 1-5, wherein the penetration attachment panel is not attached to the sheathing board and is held in contact with the rear-facing surface of the sheathing board solely by the encapsulation provided by the foam.

7. The wall structure of any one of clauses 1-5, wherein the penetration attachment panel is attached to the sheathing board with an adhesive.

8. The wall structure of clause 7, wherein the penetration attachment panel is positioned on the sheathing board with one or more positioning devices.

9. The wall structure of clause 7, wherein the penetration attachment panel is attached to the sheathing board with an adhesive comprising a foam material that is the same material comprising the foam layer.

10. The wall structure of any one of clauses 1-9, wherein the penetration attachment panel comprises a wood panel, a plywood panel, an oriented strand board (OSB) panel, a wood-thermoplastic composite panel, or a formed thermoplastic panel.

11. The wall structure of any one of clauses 1-10, wherein the sheathing board is attached to the front faces of the first and second members, and to the front faces of the two side members, with fasteners.

12. The wall structure of clause 11, wherein the fasteners comprise nails, staples, or screws, or a combination of any thereof.

13. The wall structure of any one of clauses 1-12, wherein the sheathing board is attached to the front faces of the first and second members, and to the front faces of the two side members, with an adhesive.

14. The wall structure of clause 13, wherein the adhesive comprises a foam material that is the same material comprising the foam layer.

15. The wall structure of any one of clauses 1-14, wherein the foam layer comprises a thickness extending from the rear-facing surface of the sheathing board to a position intermediate the front frame surface and the rear frame surface such that a gap is formed within the frame between a rear-facing surface of the foam layer and the rear frame surface.

16. The wall structure of any one of clauses 1-15, wherein the frame further comprises one or more secondary support members extending between two adjacent primary support members, or extending between a primary support member and a side member, such that a secondary opening is formed within the frame.

17. The wall structure of clause 16, wherein the secondary opening is free of foam, and a corresponding opening is present in the sheathing board.

18. The wall structure of clause 16, wherein the frame further comprises one or more tertiary support members extending between two secondary support members, or extending between a secondary support member and the first member or the second member.

19. The wall structure of any one of clauses 1-18, wherein the foam layer comprises polyurethane or polyisocyanurate, or mixtures thereof.

20. The wall structure of any one of clauses 1-19, wherein the foam layer is substantially free of halogen-containing flame retardant additives.

21. The wall structure of any one of clauses 1-20, wherein the foam layer is completely free of halogen containing flame retardant additives.

22. The wall structure of any one of clauses 1-21, wherein the sheathing board comprises a polyiso board, an expanded polystyrene board, an extruded polystyrene board, a gypsum board, a cement board, an adhesive-bonded and laminated cellulosic fiberboard, an asphalt-impregnated cellulosic fiberboard, a thermoset resin-wood composite board, a thermoset resin-mineral wool composite board, or a T1-11 siding board.

23. The wall structure of any one of clauses 1-22, wherein the sheathing board comprises a polyiso board comprising a polyisocyanurate foam layer and a facer material attached to a front face and/or a rear face of the polyisocyanurate foam layer.

24. The wall structure of any one of clauses 1-23, wherein the sheathing board comprises facer materials attached to and substantially covering the front face and the rear face of a core layer.

25. The wall structure of clause 23 or clause 24, wherein the facer material comprises fiberglass mat, glass fiber-reinforced cellulosic felt, coated and polymer-bonded fiber mat, foil, coated foil, foil/membrane laminate, foil/glass composite, or polyolefin film.

26. The wall structure of any one of clauses 1-25, further comprising a penetration opening through the sheathing board, the penetration attachment panel, and the foam layer, wherein the penetration opening connects a front-facing surface of the sheathing board and a rear-facing surface of the foam layer.

27. A method of manufacturing a wall structure comprising: providing a frame, the frame comprising: a first member; a second member spaced apart from the first member; and two side members extending between the first member and the second member, wherein the first member, the second member, and the two side members each comprise a front surface and a rear surface that form a front frame surface and a rear frame surface; attaching a sheathing board to the front frame surface, wherein the sheathing board, the first and second members, and the two side members define a cavity within the frame; positioning a penetration attachment panel within the cavity and in contact with a rear-facing surface of the sheathing board; and depositing a foam layer into the cavity, wherein the foam layer covers the penetration attachment panel and the sheathing board.

28. The method of clause 27, further comprising curing the foam layer, wherein the cured foam layer adheres to the penetration attachment panel and the sheathing board, and wherein the cured foam layer encapsulates the penetration attachment panel.

29. The method of clause 27 or clause 28, further comprising depositing a layer of foam onto the rear-facing surface of the sheathing board before positioning the penetration attachment panel within the cavity and in contact with the rear-facing surface of the sheathing board.

30. The method of any one of clauses 27-29, further comprising depositing a layer of foam onto the rear-facing surface of the sheathing board before attaching the sheathing board to the front frame surface.

31. The method of any one of clauses 27-30, wherein the positioning of the penetration attachment panel does not comprise attaching the penetration attachment panel to the sheathing board.

32. The method of any one of clauses 27-30, wherein the positioning of the penetration attachment panel comprises positioning the penetration attachment panel on the sheathing board with one or more positioning devices.

33. The method of any one of clauses 27-32, wherein the attaching of the sheathing board to the front frame surface comprises attaching the sheathing board to the front faces of the first and second members, and to the front faces of the two side members, with fasteners, wherein the fasteners comprise nails, staples, or screws, or a combination of any thereof.

34. The method of any one of clauses 27-33, wherein the attaching of the sheathing board to the front frame surface comprises attaching the sheathing board to the front faces of the first and second members, and to the front faces of the two side members, with an adhesive.

35. The method of any one of clauses 27-34, wherein the foam layer is deposited to a thickness extending from the rear-facing surface of the sheathing board to a position intermediate the front frame surface and the rear frame surface such that a gap is formed within the frame between a rear-facing surface of the foam layer and the rear frame surface.

36. The method of any one of clauses 27-35, wherein the sheathing board comprises a polyiso board comprising a polyisocyanurate foam layer and facer materials attached to and covering a front face and a rear face of the polyisocyanurate foam layer.

Various features and characteristics of the inventions are described in this specification to provide an overall understanding of the disclosed wall structures and method of manufacture. It is understood that the various features and characteristics described in this specification can be combined in any suitable manner regardless of whether such features and characteristics are expressly described in combination in this specification. The Applicant expressly intends such combinations of features and characteristics to be included within the scope of this specification. As such, the claims can be amended to recite, in any combination, any features and characteristics expressly or inherently described in, or otherwise expressly or inherently supported by, this specification. Furthermore, the Applicant reserves the right to amend the claims to affirmatively disclaim features and characteristics that may be present in the prior art, even if those features and characteristics are not expressly described in this specification. Therefore, any such amendments will not add new matter to the specification or claims, and will comply with written description and sufficiency of description requirements (e.g., 35 U.S.C. § 112(a) and Article 123(2) EPC). The wall structures and methods disclosed in this specification can comprise, consist of, or consist essentially of the various features and characteristics described in this specification.

Also, any numerical range recited in this specification describes all sub-ranges of the same numerical precision (i.e., having the same number of specified digits) subsumed within the recited range. For example, a recited range of "1.0 to 10.0" describes all sub-ranges between (and including) the recited minimum value of 1.0 and the recited maximum value of 10.0, such as, for example, "2.4 to 7.6," even if the range of "2.4 to 7.6" is not expressly recited in the text of the specification. Accordingly, the Applicant reserves the right to amend this specification, including the claims, to expressly recite any sub-range of the same numerical precision subsumed within the ranges expressly recited in this specification. All such ranges are inherently described in this specification such that amending to expressly recite any such sub-ranges will not add new matter to the specification or claims, and will comply with written description and sufficiency of description requirements (e.g., 35 U.S.C. § § 112(a) and Article 123(2) EPC). Additionally, numerical parameters described in this specification should be construed in light of the number of reported significant digits, the numerical precision of the number, and by applying ordinary rounding techniques. It is also understood that numerical parameters described in this specification will necessarily possess the inherent variability characteristic of the underlying measurement techniques used to determine the numerical value of the parameter.

Any patent, publication, or other disclosure material identified in this specification is incorporated by reference into this specification in its entirety unless otherwise indicated, but only to the extent that the incorporated material does not conflict with existing descriptions, definitions, statements, or other disclosure material expressly set forth in this specification. As such, and to the extent necessary, the express disclosure as set forth in this specification supersedes any conflicting material incorporated by reference. Any material, or portion thereof, that is incorporated by reference into this specification, but which conflicts with existing definitions, statements, or other disclosure material set forth in this specification, is only incorporated to the extent that no conflict arises between that incorporated material and the existing disclosure material. Applicant reserves the right to amend this specification to expressly recite any subject matter, or portion thereof, incorporated by reference.

The grammatical articles "one", "a", "an", and "the", as used in this specification, are intended to include "at least one" or "one or more", unless otherwise indicated. Thus, the articles are used in this specification to refer to one or more than one (i.e., to "at least one") of the grammatical objects of the article. By way of example, "a component" means one or more components, and thus, possibly, more than one component is contemplated and can be employed or used in an implementation of the described processes, compositions, and products. Further, the use of a singular noun includes the plural, and the use of a plural noun includes the singular, unless the context of the usage requires otherwise.

What is claimed is:

1. A wall structure comprising:

a frame comprising:

a first member;

a second member spaced apart from the first member; and connecting members extending from the first member to the second member, wherein the first member, the second member, and the connecting members each comprise a front surface and a rear surface that form a front frame surface and a rear frame surface and wherein the first member, the second member and the connecting members are secured together with fasteners;

a foam board attached to the front frame surface, wherein the foam board, the first and second members, and the connecting members define at least one cavity within the frame;

a penetration attachment panel positioned between connecting members within at least one cavity and in contact with a rear-facing surface of the foam board, wherein the penetration attachment panel is positioned and dimensioned so that there is at least one space within the cavity between the penetration attachment panel and the first member and/or the second member; and a foam layer located within the cavity, wherein the foam layer adheres to the penetration attachment panel and the foam board, and is located in the at least one space to thereby encapsulate the penetration attachment panel, wherein the wall structure comprises a penetration opening through the foam board, the penetration attachment panel, and the foam layer that connects a front-facing surface of the foam board and a rear-facing surface of the foam layer, wherein the foam layer comprises a thickness extending from the rear-facing surface of the foam board to a position intermediate the front frame surface and the rear frame surface so that the wall structure comprises a gap within the frame between a rear-facing surface of the foam layer and the rear frame surface, and wherein the penetration attachment panel is positioned in the cavity around the penetration opening and is adapted for attachment to an exterior fixture with attachment fasteners that penetrate through the foam board and engage with the penetration attachment panel thereby connecting the exterior fixture to the gap.

2. The wall structure of claim 1, wherein the penetration attachment panel is not attached to the foam board and is held in contact with the rear-facing surface of the foam board solely by the encapsulation provided by the foam.

3. The wall structure of claim 1, wherein the penetration attachment panel is attached to the foam board with an adhesive.

4. The wall structure of claim 1, wherein the penetration attachment panel is positioned on the foam board with one or more positioning devices comprising one or more fasteners located through the thickness of the penetration attachment panel and engaging the foam board, but not penetrating through the thickness of the foam board.

5. The wall structure of claim 1, wherein the penetration attachment panel comprises a wood panel, a plywood panel, an oriented strand board (OSB) panel, a wood-thermoplastic composite panel, or a formed thermoplastic panel.

6. The wall structure of claim 1, wherein the foam board is attached to the front faces of the first and second members, and to the front faces of the connecting members, with fasteners.

7. The wall structure of claim 1, wherein the foam board is attached to the front faces of the first and second members, and to the front faces of the connecting members, with an adhesive.

8. The wall structure of claim 1, wherein the foam layer comprises polyurethane or polyisocyanurate, or mixtures thereof.

9. The wall structure of claim 1, wherein the foam board comprises a polyiso board, an expanded polystyrene board, or an extruded polystyrene board.

10. The wall structure of claim 1, wherein the foam board comprises a polyiso board comprising a polyisocyanurate foam layer and facer materials attached to a front face and a rear face of the polyisocyanurate foam layer.

11. The wall structure of claim 10, wherein the facer materials comprise fiberglass mat, glass fiber-reinforced cellulosic felt, coated and polymer-bonded fiberglass mat, foil, coated foil, foil/membrane laminate, foil/glass composite, or polyolefin film.

12. The wall structure of claim 1, wherein the penetration opening is configured to provide an open connection between an exterior side of the wall structure and an interior side of the wall structure.

13. The wall structure of claim 1, where the foam layer attaches the penetration attachment panel to the foam board.

14. The wall structure of claim 1, wherein the foam board is integrated with exterior cladding.

15. A method of manufacturing a wall structure comprising:

providing a frame, the frame comprising:

a first member;

a second member spaced apart from the first member; and connecting members extending from the first member to the second member, wherein the first member, the second member, and the connecting members each comprise a front surface and a rear surface that form a front frame surface and a rear frame surface and wherein the first member, the second member and the connecting members are secured together with fasteners;

attaching a foam board to the front frame surface, wherein the foam board, the first and second members, and the connecting members define at least one cavity within the frame;

positioning a penetration attachment panel within at least one cavity and in contact with a rear-facing surface of the foam board, wherein the penetration attachment panel is positioned and dimensioned so that there is at least one space within the cavity between the penetration attachment panel and the first member and/or the second member;

depositing a foam layer into the cavity, wherein the foam layer covers the penetration attachment panel and the foam board; and curing the foam layer, wherein the cured foam layer adheres to the penetration attachment panel and the foam board, and is located in the at least one space to thereby encapsulate the penetration attachment panel, and forming a penetration opening through the foam board, the penetration attachment panel, and the foam layer that connects a front-facing surface of the foam board and a rear-facing surface of the foam layer, wherein the foam layer is deposited to a thickness extending from the rear-facing surface of the foam board to a position intermediate the front frame surface and the rear frame surface so that the wall structure comprises a gap within the frame between a rear-facing surface of the foam layer and the rear frame surface, and wherein the penetration attachment panel is positioned around the penetration opening such that the penetration attachment panel is adapted for attachment to an exterior fixture with attachment fasteners that penetrate through the foam board and engage with the penetration attachment panel thereby connecting the exterior fixture to the gap.

16. The method of claim 15, further comprising depositing a layer of foam onto the rear-facing surface of the foam board before positioning the penetration attachment panel within the cavity and in contact with the rear-facing surface of the foam board.

17. The method of claim 15, wherein the positioning of the penetration attachment panel does not comprise attaching the penetration attachment panel to the foam board.

18. The method of claim 15, wherein the positioning of the penetration attachment panel comprises positioning the penetration attachment panel on the foam board with one or more positioning devices comprising one or more fasteners located through the thickness of the penetration attachment panel and engaging the foam board, but not penetrating through the thickness of the foam board.

19. The method of claim 15, wherein the attaching of the foam board to the front frame surface comprises attaching the foam board to the front faces of the first and second members, and to the front faces of the connecting members, with fasteners, wherein the fasteners comprise nails, staples, or screws, or a combination of any thereof.

20. The method of claim 15, wherein the attaching of the foam board to the front frame surface comprises attaching the foam board to the front faces of the first and second members, and to the front faces of the connecting members, with an adhesive.

21. The method of claim 15, wherein the foam board comprises a polyiso board comprising a polyisocyanurate foam layer and facer materials attached to and covering a front face and a rear face of the polyisocyanurate foam layer.

22. The method of claim 21, wherein the facer materials comprise fiberglass mat, glass fiber-reinforced cellulosic felt, coated and polymer-bonded fiber mat, foil, coated foil, foil/membrane laminate, foil/glass composite, or polyolefin film.

23. The method of claim 15, wherein the penetration opening provides an open connection between an exterior side of the wall structure and an interior side of the wall structure.

24. The method of claim 15, wherein the foam layer attaches the penetration attachment panel to the foam board.

25. The method of claim 15, wherein the foam board is integrated with exterior cladding.

* * * * *